US009635945B2

(12) United States Patent
Smithwick et al.

(10) Patent No.: US 9,635,945 B2
(45) Date of Patent: May 2, 2017

(54) CONFIGURABLE LOUNGE FURNISHING

(71) Applicant: Target Brands, Inc., Minneapolis, MN (US)

(72) Inventors: George K. Smithwick, Blaine, MN (US); David R. Angel, Minneapolis, MN (US); Chad M. Bogdan, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 250 days.

(21) Appl. No.: 14/295,674

(22) Filed: Jun. 4, 2014

(65) Prior Publication Data

US 2015/0351551 A1 Dec. 10, 2015

(51) Int. Cl.
*A47C 7/40* (2006.01)

(52) U.S. Cl.
CPC ..... *A47C 7/407* (2013.01)

(58) Field of Classification Search
CPC ..... A47C 7/407; A47C 7/40; A47C 4/028; A47C 7/48
See application file for complete search history.

(56) References Cited

U.S. PATENT DOCUMENTS 811,475 A 1/1906 Bradley
2,201,903 A * 5/1940 Krakauer ..... A47C 17/17 16/333
2,655,203 A 10/1953 Wegner
2,692,639 A 10/1954 Genovese
2,705,994 A 4/1955 Stattler
2,716,775 A * 9/1955 Kenimer ..... A47C 13/005 16/357
2,755,487 A * 7/1956 Harman ..... E05D 11/1014 33/123
3,001,822 A 9/1961 Pagliaro et al.
3,655,242 A 4/1972 Ghyczy
3,872,523 A * 3/1975 Garza ..... A47C 17/165 5/12.1
4,318,568 A * 3/1982 Ericsson ..... A47C 20/04 297/354.1
4,865,387 A 9/1989 Lipparini et al.
5,374,108 A 12/1994 Saul et al.
(Continued)

OTHER PUBLICATIONS

Brookstone, "Palm Harbor 3pc Outdoor Wicker Set," http://www.brookstone.com/palm-harbor-3pc-outdoor-wicker-set-loveseat-two-chairs?bkiid=Related_Items_Zone|ProductDetails|Accesories|827071p, at least as early as Oct. 2013, 1 page.

(Continued)

*Primary Examiner* — David R Dunn
*Assistant Examiner* — Tania Abraham
(74) *Attorney, Agent, or Firm* — Leanne Taveggia Farrell; Westman, Champlin & Koehler, P.A.

(57) ABSTRACT

A furnishing includes a seat and a base that supports the seat. The furnishing further includes a geometrically shaped backrest that is pivotal relative to the seat and has at least a front, a back, a bottom, a right side and a left side that is substantially parallel with the right side. The furnishing further includes at least one hinge including a first hinge body attached to and protruding from the seat and a second hinge body attached to and protruding from the backrest. The first hinge body is coupled to the second hinge body at a pivot point. The pivot point is spaced apart from the seat and spaced apart from the backrest.

19 Claims, 24 Drawing Sheets

(56) References Cited

U.S. PATENT DOCUMENTS

| | | | | |
|---|---|---|---|---|
| 5,531,506 | A * | 7/1996 | Scott | A47C 7/68 297/125 |
| 6,189,973 | B1 * | 2/2001 | Wu | A47C 4/52 297/378.1 |
| 6,786,553 | B1 | 9/2004 | Grove | |
| 6,926,363 | B2 * | 8/2005 | Yamashita | A47C 1/026 16/321 |
| 7,000,993 | B2 | 2/2006 | Lee | |
| 7,040,693 | B1 | 5/2006 | Dorner et al. | |
| 7,309,101 | B2 | 12/2007 | True | |
| 7,527,337 | B2 * | 5/2009 | Clay | A47C 7/407 297/378.12 |
| 7,681,945 | B1 | 3/2010 | Wiecek et al. | |
| 7,735,914 | B2 | 6/2010 | Longnecker | |
| 7,832,797 | B2 | 11/2010 | Miyakawa | |
| 8,356,954 | B2 * | 1/2013 | Koch | A47C 17/02 403/353 |
| 2002/0000740 | A1 * | 1/2002 | Laughlin | A47C 4/02 297/36 |
| 2005/0023876 | A1 | 2/2005 | Savage | |
| 2007/0200409 | A1 * | 8/2007 | Ahrens | A47C 1/126 297/378.1 |
| 2010/0060065 | A1 * | 3/2010 | Hung | A47C 7/407 297/378.1 |
| 2011/0101757 | A1 | 5/2011 | Powell | |
| 2011/0210593 | A1 * | 9/2011 | Klaasen | A47C 7/407 297/378.12 |
| 2011/0233976 | A1 * | 9/2011 | Hanson | A47C 4/02 297/217.1 |
| 2012/0248842 | A1 * | 10/2012 | Brandtner | A47C 4/02 297/411.2 |
| 2013/0193728 | A1 | 8/2013 | Wang | |
| 2013/0229032 | A1 * | 9/2013 | Monahan | A47C 4/08 297/44 |
| 2013/0320741 | A1 * | 12/2013 | Brandtner | A47C 17/02 297/440.1 |

OTHER PUBLICATIONS

Restoration Hardware, "Biscayne Collection," http://www.restorationhardware.com/catalog/category/products.jsp?link=BiscayneGrey&categoryId=cat1760219, at least as early as Oct. 2013, 1 page.

Office Action from Canadian Patent Application No. 2,857,902, mailed Sep. 24, 2014 (2 pages).

* cited by examiner

CONFIGURABLE LOUNGE FURNISHING

BACKGROUND

Knock down or ready-to-assemble furniture is a type of furniture that is in at least a partially disassembled configuration when packaged in a shipping container or carton. The package includes not only the disassembled furniture, but also assembly instructions and hardware needed to build the furniture. Because knock down furniture does not have to be assembled at the factory and is more efficiently packed, customers enjoy significant cost savings over furniture that is already fully assembled.

The discussion above is merely provided for general background information and is not intended to be used as an aid in determining the scope of the claimed subject matter.

SUMMARY

A furnishing includes a seat and a base that supports the seat. The furnishing further includes a geometrically shaped backrest that is pivotal relative to the seat and has at least a front, a back, a bottom, a right side and a left side that is substantially parallel with the right side. The furnishing further includes at least one hinge including a first hinge body attached to and protruding from the seat and a second hinge body attached to and protruding from the backrest. The first hinge body is coupled to the second hinge body at a pivot point. The pivot point is spaced apart from the seat and spaced apart from the backrest.

In another embodiment, a furnishing includes a first frame structure forming a first leg support and a first armrest and a second frame structure spaced apart from the first frame structure and forming a second leg support and a second armrest. A surface is located between the first frame structure and the second frame structure and is positioned above the bottoms of the first and second frame structures and positioned below the first and second armrests of the first and second frame structures to form a seat. A third frame structure is located between the first frame structure and the second frame structure and is rotatably coupled to the surface to form a backrest. The third frame structure is located entirely below the first armrest and the second armrest of the first and second frame structures when the third frame structure is in a shipping configuration. The third frame structure protrudes above the first armrest and the second armrest of the first and second frame structures when the third frame structure is in a use configuration.

A method of assembling a furnishing is also provided. A backrest that is pivotally coupled to a seat by at least one hinge is rotated from a first position where the backrest is entirely positioned below a pair of armrests to a second position where a top of the backrest is located above the pair of armrests. The backrest is then fastened to the seat.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A configurable lounge furnishing combines the benefits of factory assembled furniture with the benefits of knock down or ready-to-assemble furniture. The furnishing includes a rotatable backrest that is pivotally coupled to a seat with at least one hinge. The backrest rotates from a position for shipping the furnishing to a position for using the furnishing. The pivot point of the at least one pivotal mechanism is spaced apart from the seat and spaced apart from the backrest. In this way, the pivot point of the at least one pivotal mechanism does not interfere with the material used to cover or upholster the furnishing and is protected from the user by a removable cushion in the use configuration.

Lounge furnishings are pieces of seating furniture having a support structure, which is covered by upholstery, cushioning or other types of material, such as wicker weave, for supporting a user in a sitting or lounging position. In particular, a club chair is a type of lounge furnishing that includes a seat, a backrest and a pair of armrests for accommodating a single person. A sofa is a type of lounge furnishing that also includes a seat, backrest and a pair of arms rests, but is for accommodating more than one person.

The large, uneven size of lounge furnishings, however, prevents their efficient packaging. Inefficient packaging results in higher delivery costs to the customer, unwanted shifting of the furniture during shipping, uneven weight distributions, awkward maneuvering of the furniture and damage to the furniture. Ready-to-assemble lounge furnishings resolve the drawbacks of shipping factory-assembled furniture, but provide other challenges. For example, customers who assemble ready-to-assemble furniture are untrained and may not have access to the proper tools to properly assemble the furniture. In addition, many of the components of lounge furniture are heavy and it may be difficult for an individual to properly align pieces during assembly. As a result, lounge furnishings that are built at a factory tend to be better assembled with minimal gaps.

FIGS. 1-10 illustrate various views of a furnishing 100. Furnishing 100 is a lounge chair or club chair and includes a width sized to accommodate a single person or user.

Figure 1A:
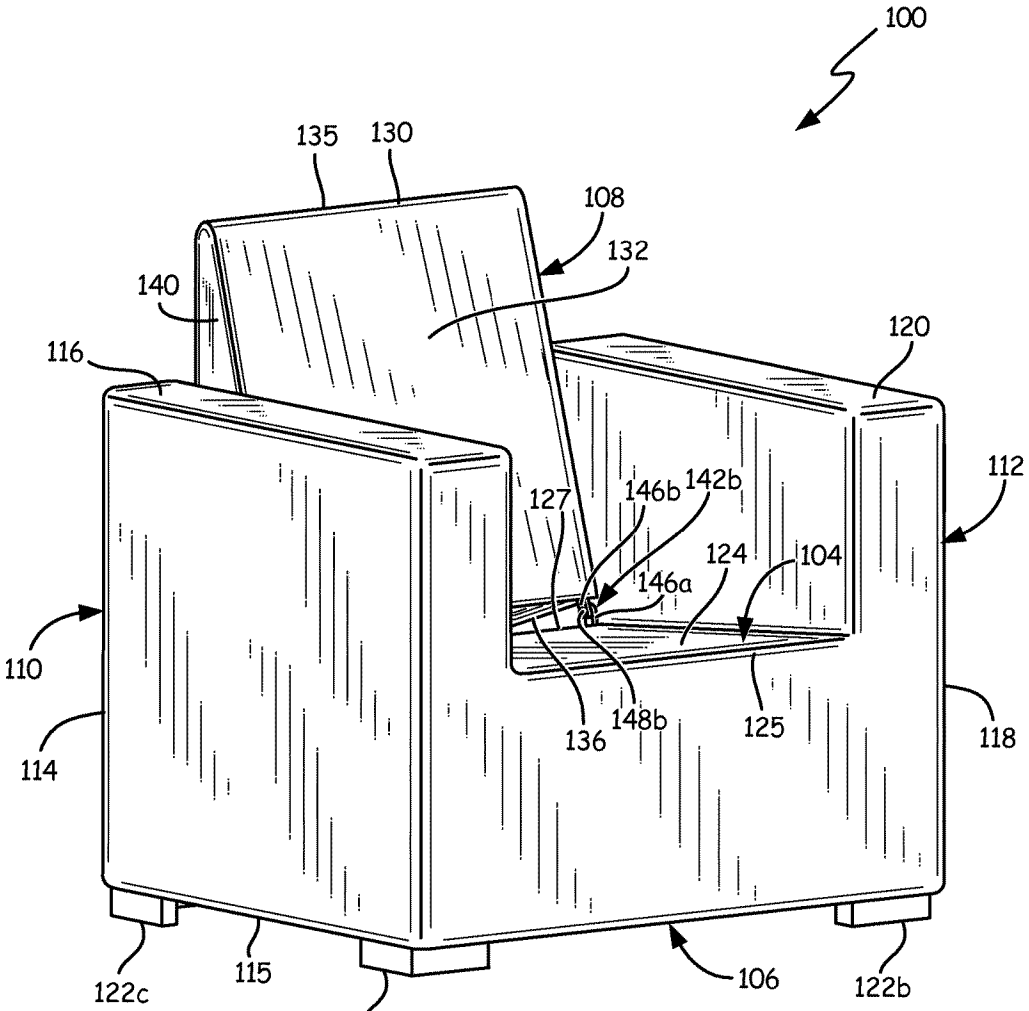
FIG. 1A is a perspective view of a furnishing in a use configuration according to one embodiment.
Figure 1B:
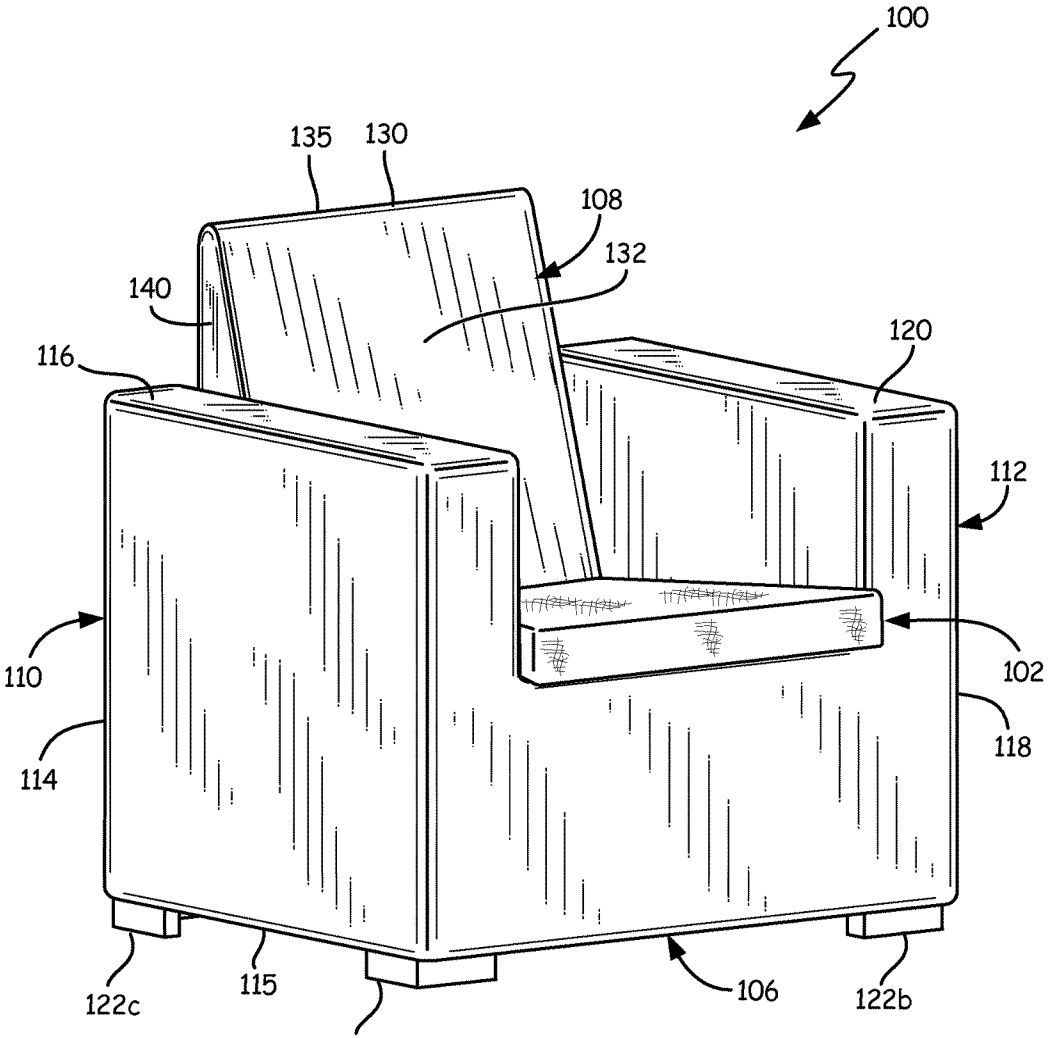
FIG. 1B is a perspective view of FIG. 1A showing a cushion on a seat of the furnishing.
Figure 2:
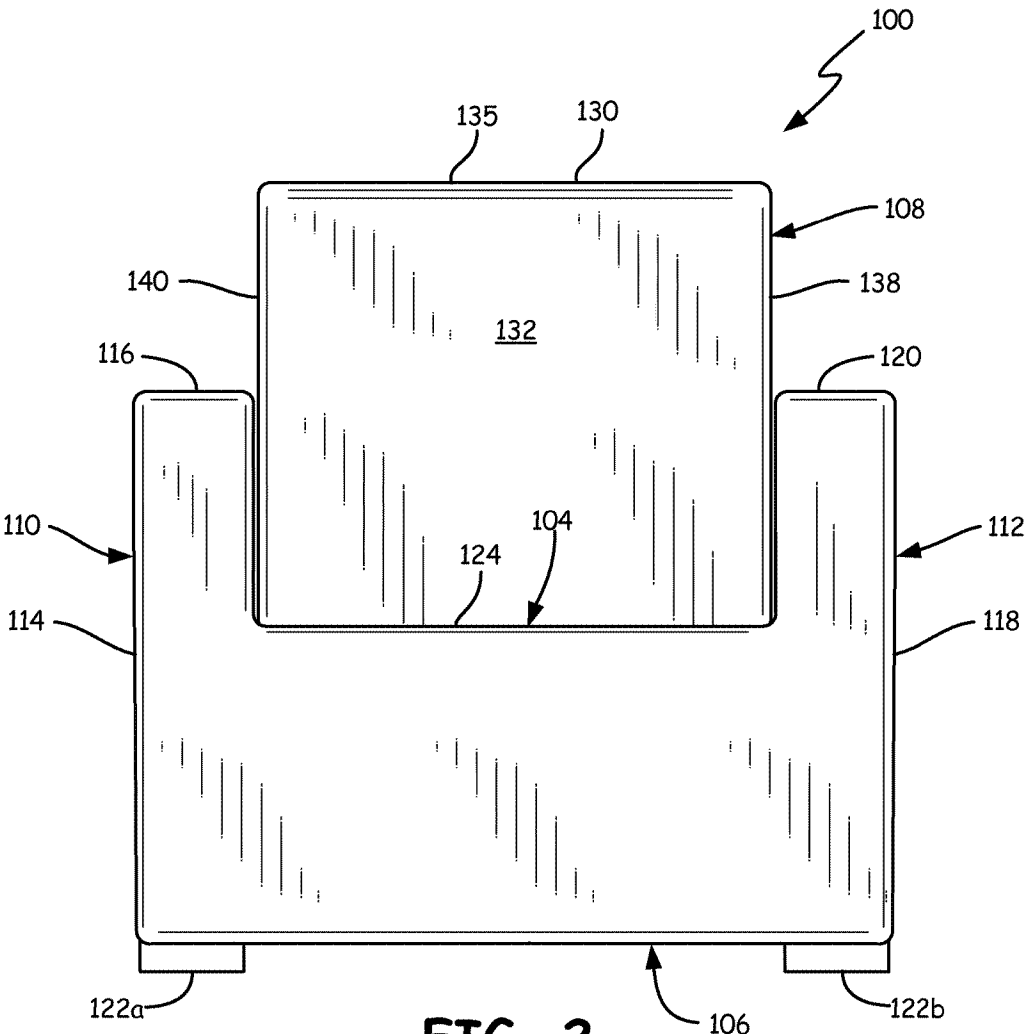
FIG. 2 is a front view of FIG. 1A.
Figure 3:
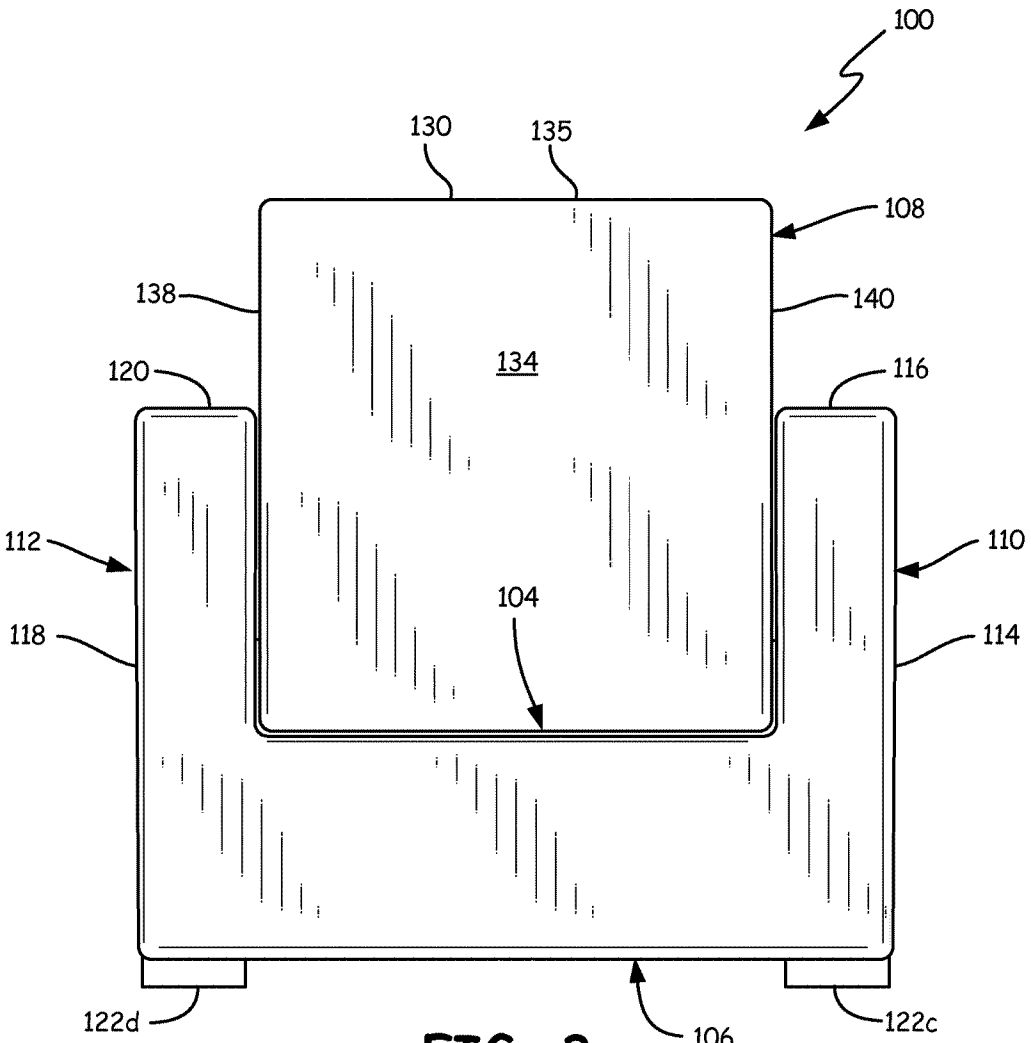
FIG. 3 is a back view of FIG. 1A.
Figure 4:
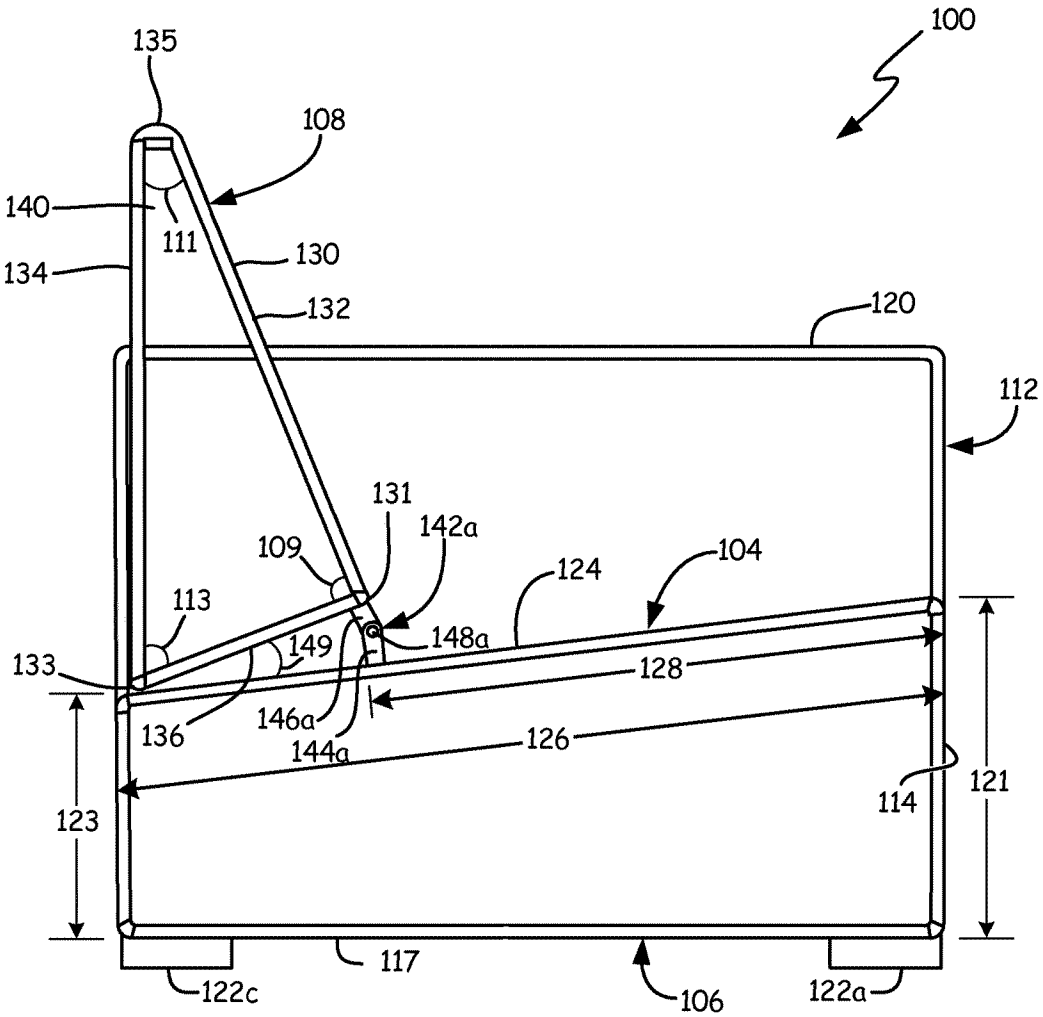
FIG. 4 is a side view of FIG. 1A with a first frame structure and upholstery removed so as to illustrate the structural framework of the furnishing.
Figure 5:
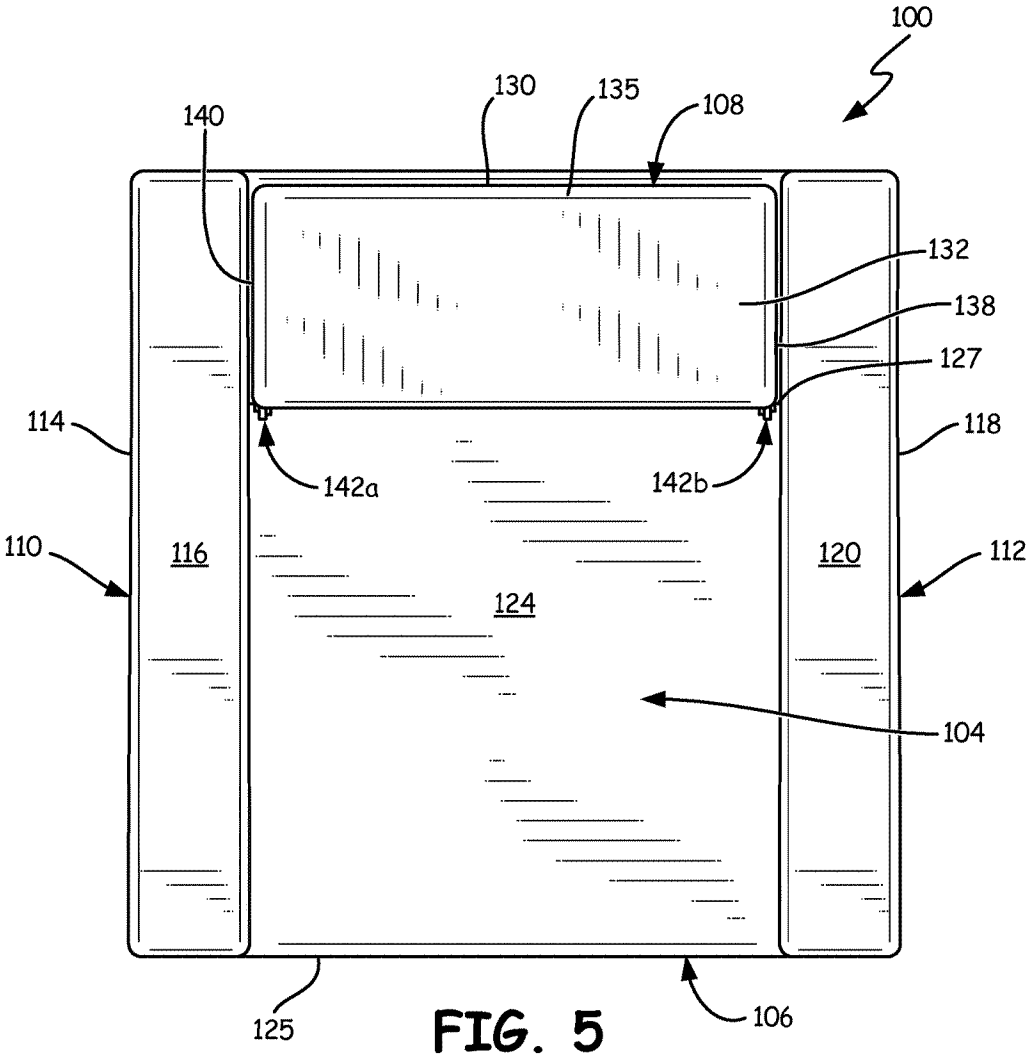
FIG. 5 is a top view of FIG. 1A.

FIG. 1A is a perspective view of a furnishing 100 in a use configuration according to one embodiment. FIG. 1B is a perspective view of FIG. 1A showing a cushion 102 on a seat 104 of furnishing 100 in the use configuration. FIG. 2 is a front view of furnishing 100 in the use configuration, FIG. 3 is a back view of furnishing 100 in the use configuration and FIG. 5 is a top view of furnishing 100 in the use configuration. FIG. 4 is a side view with a first frame structure 110 and upholstery, cushioning or other types of material, such as wicker weave, removed so as to illustrate the structural framework of furnishing 100 in the use configuration.

Figure 6:
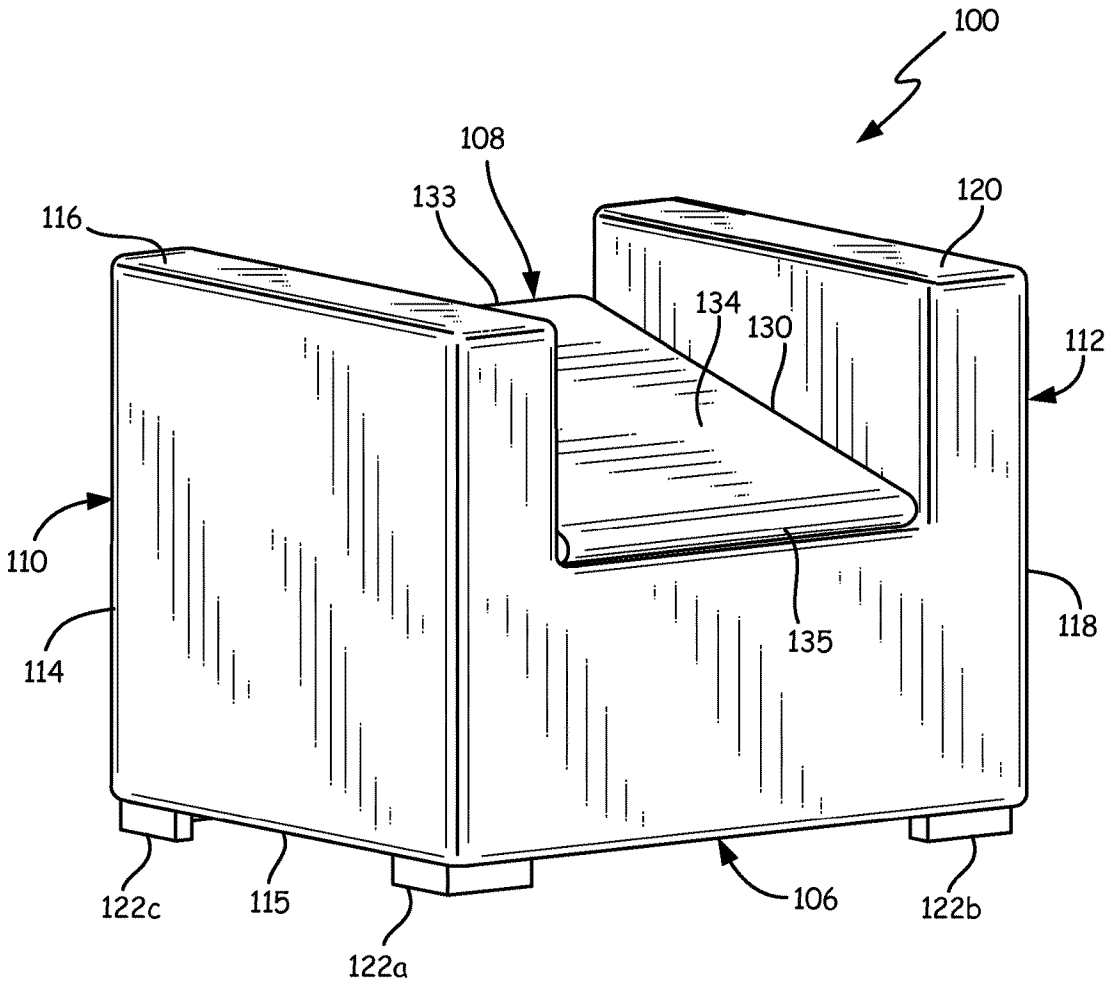
FIG. 6 is a perspective view of the furnishing in FIG. 1A in a shipping configuration.
Figure 7:
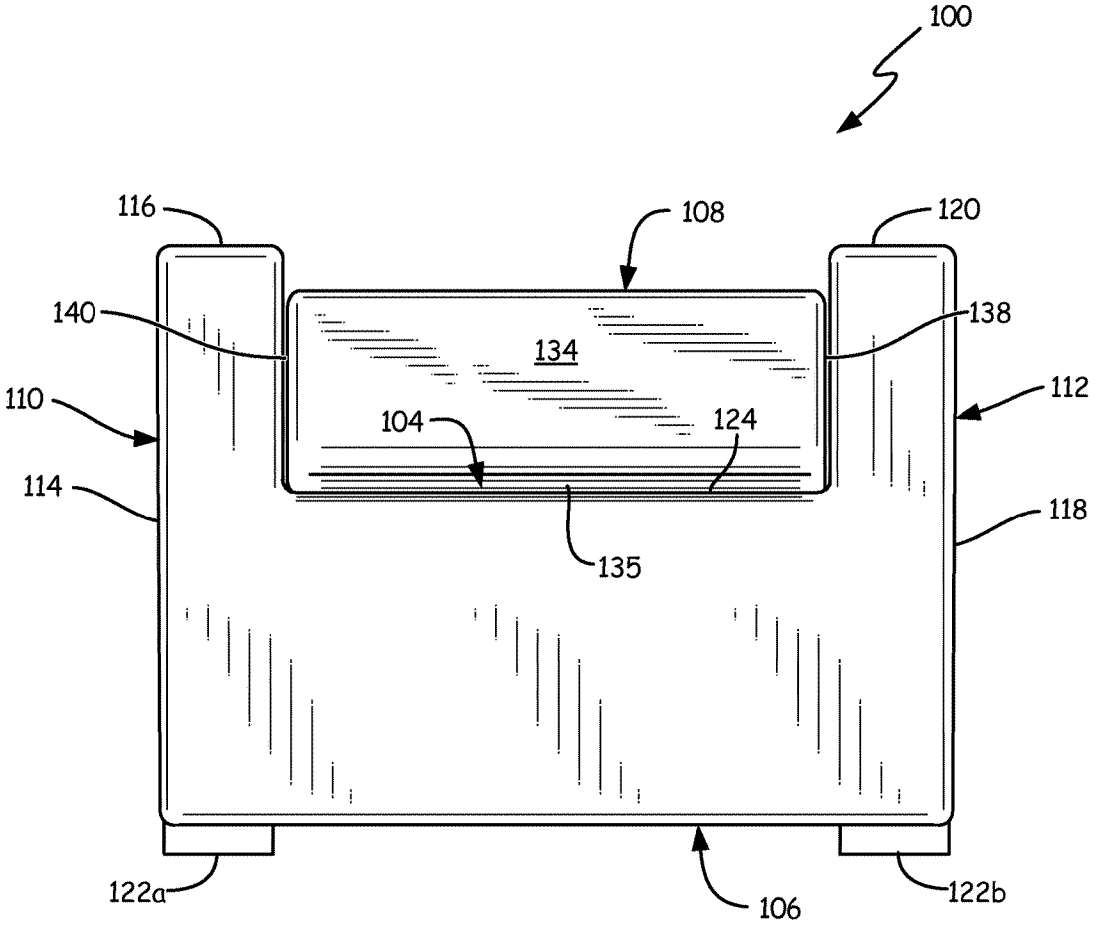
FIG. 7 is a front view of FIG. 6.
Figure 8:
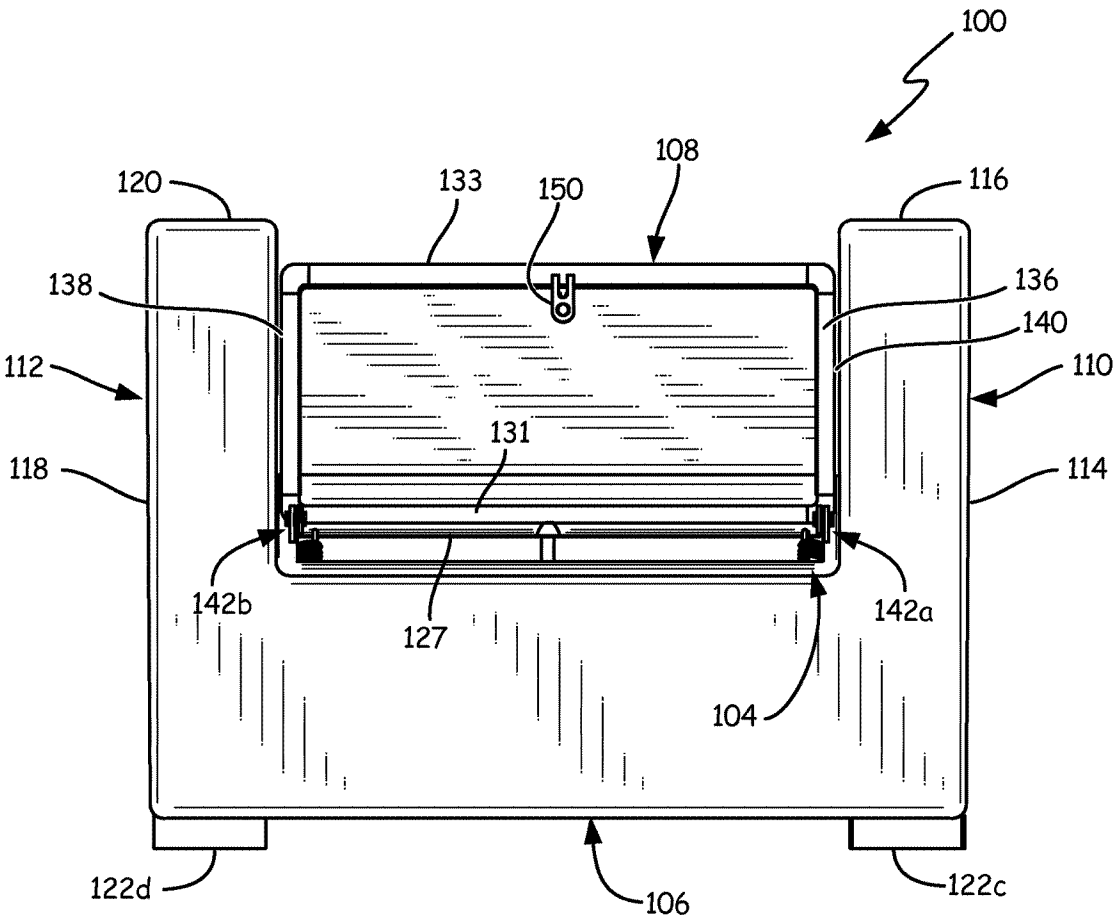
FIG. 8 is a back view of FIG. 6.
Figure 9A:
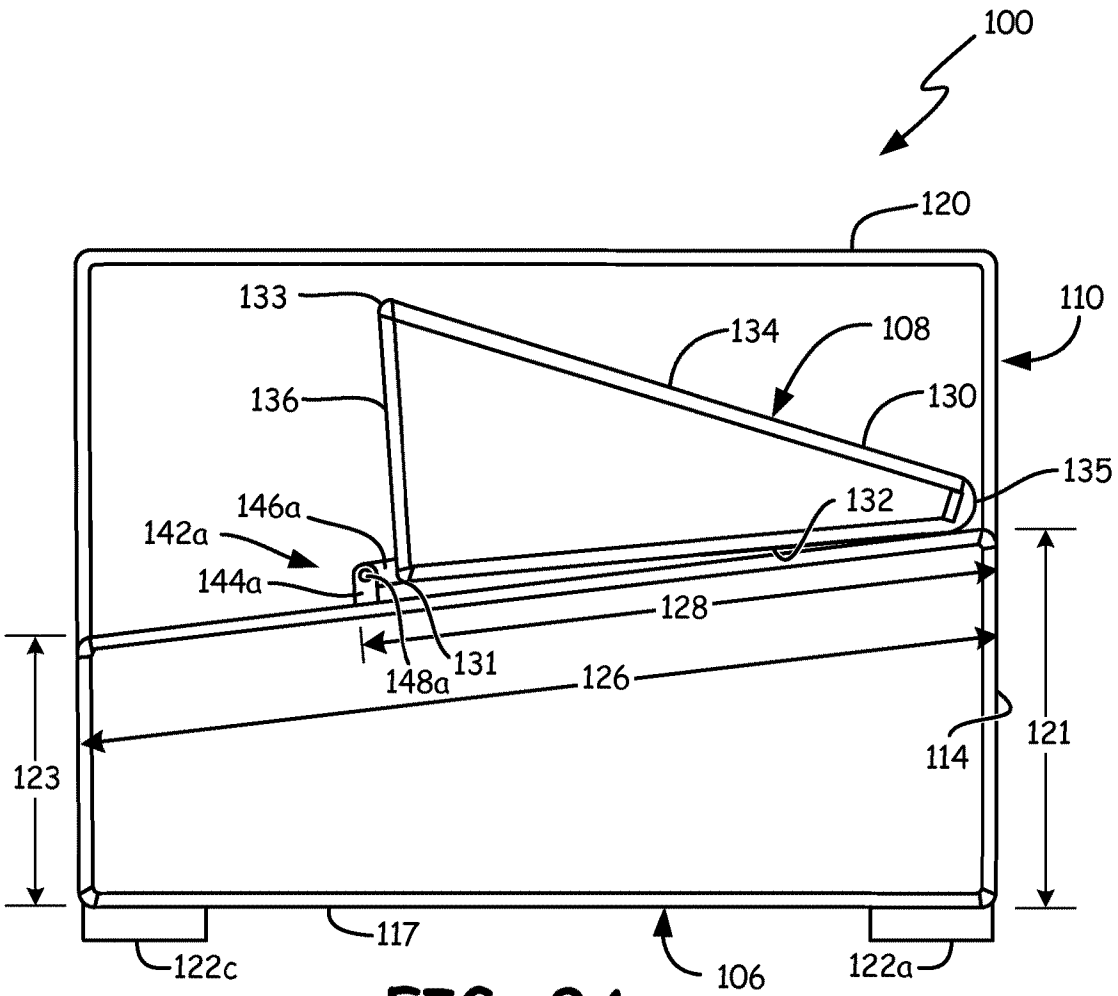
FIG. 9A is a side view of FIG. 6 with a first frame structure and upholstery removed so as to illustrate the structural framework of the furnishing.
Figure 9B:
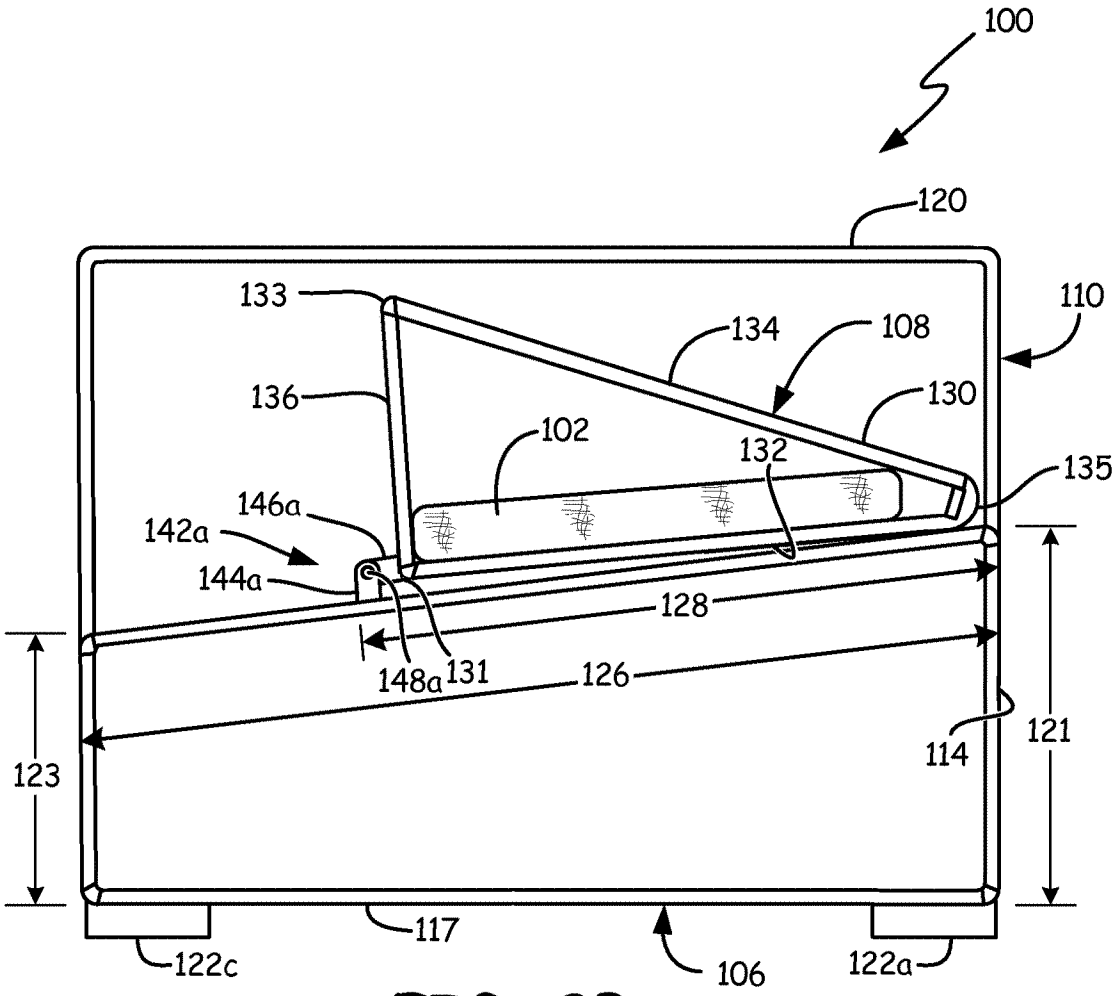
FIG. 9B is the side view of FIG. 9A with a cushion stored inside an interior of the backrest.
Figure 10:
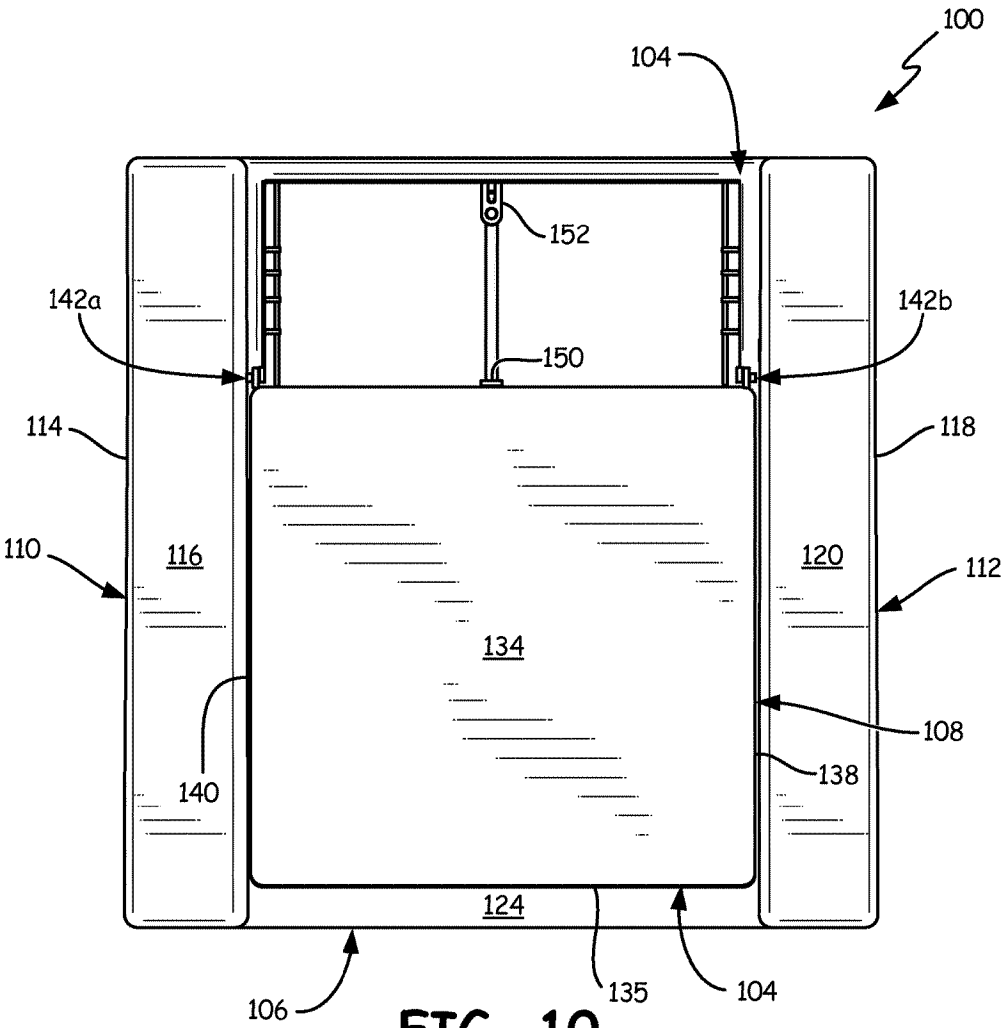
FIG. 10 is a top view of FIG. 6.

FIG. 6 is a perspective view of furnishing 100 in a shipping configuration according to another embodiment. FIG. 7 is a front view of furnishing 100 in the shipping configuration, FIG. 8 is a back view of furnishing 100 in the shipping configuration and FIG. 10 is a top view of furnishing 100 in the shipping configuration. FIG. 9A is a side view with a first frame structure 110 and upholstery, cushioning or other types of materials, such as wicker weave, removed so as to illustrated the structural framework of furnishing 100 in the shipping configuration. FIG. 9B is the side view of FIG. 9A, but with cushion 102 being stored inside backrest 108 in the shipping configuration. Cushion 102 will be discussed in detail below.

Furnishing 100 includes seat 104, a base 106 and a backrest 108. Base 106 supports seat 104 and includes a first frame structure 110 and a second frame structure 112. First frame structure 110 forms a first leg support 114 having a bottom 115 and a first armrest 116. Second frame structure 112 forms a second leg support 118 having a bottom 117 and a second armrest 120. First frame structure 110 is spaced apart from second frame structure 112. Base 106 also includes a plurality of feet 122*a*, 122*b*, 122*c* and 122*d* coupled to bottoms 115 and 117 that allow base 106 to rest on a floor.

Seat 104 includes a seat frame structure as illustrated in FIGS. 4, 9A and 9B, which extends from a front of first and second frame structures 110 and 112 to a back of first and second frame structures 110 and 112. Seat 104 is located between first frame structure 110 and second frame structure 112 and includes a seat surface 124. Seat surface 124 is raised above the floor such that it is positioned above bottoms 115 and 117 of first and second frame structures 110 and 112 and is positioned below first and second armrests 116 and 120. In particular, seat 104 is oriented at an acute angle relative to the floor or relative to bottoms 115 and 117 so that at the front of first and second frame structure 110 and 122, seat 104 is at a height 121 relative to bottoms 115 and 117 that is greater than a height 123 relative to bottoms 115 and 117 at the back of first and second frame structures 110 and 112.

Seat surface 124 does not extend for the entire depth 126 of the seat frame structure of seat 104. Rather, seat surface 124 extends from a front 125 to a back 127 (FIGS. 5 and 8), which is a usable seat depth 128 that is less than depth 126. The area between the back of first and second frame structures 110 and 112 and where seat surface 124 begins (i.e., back 127) includes an opening surrounded by the structural frame work of seat 104. This opening is best illustrated in FIG. 10. However, in other embodiments, seat surface 124 may extend from front 125 to a back of first and second frame structures 110 and 112.

Backrest 108 includes a third frame structure 130 that is pivotal relative to seat 104. Backrest 108 including third frame structure 130 is located between first frame structure 110 and second frame structure 112 and is rotatably coupled to seat surface 124 in proximity to back 127 of seat surface 124 or rotatably coupled to another portion along seat 104. Backrest 108 includes a front 132, a back 134, a top 135, a bottom 136, a right side 138 and a left side 140 that is substantially parallel with right side 138. As clearly illustrated in FIGS. 4, 9A and 9B, bottom 136 of backrest 108 is substantially normal to front 132 of backrest 108. In other words, backrest 108 is geometrically shaped and has a profile that approximates a right triangle having one right angle 109 and two other angles 111 and 113 that are unequal. Angle 111 is an acute angle that orients front 132 of backrest 108 relative to back 134 of backrest 108. Angle 113 is an acute angle that orients back 134 of backrest 108 relative to bottom 136 of backrest 108. In another embodiment, backrest 108 includes a hollow interior defined by front 132, back 134, top 135, bottom 136, right side 138 and left side 140. In this embodiment, bottom 136 includes an opening.

In one embodiment, the mechanism that allows backrest and therefore third frame structure 130 to be pivotal or rotatable includes at least one hinge. In the embodiments illustrated in FIGS. 1-10, lounge furniture 100 includes two hinges 142*a* and 142*b*. Hinge 142*a* is located in proximity to a back left corner of seat surface 124 and hinge 142*b* is located in proximity to a back right corner of seat surface 124. Each hinge 142*a* and 142*b* includes a first hinge body 144*a* and 144*b* attached to and protruding from seat 104 and a second hinge body 146*a* and 146*b* attached to and protruding from backrest 108 and therefore third frame structure 130. Each first hinge body 144*a* and 144*b* couples to each second hinge body 146*a* and 146*b*, respectively, at a pivot point 148*a* and 148*b*.

As illustrated, pivot points 148*a* and 148*b* are spaced apart from seat 104 and from backrest 108 and therefore third frame structure 130. More specifically, pivot points 148*a* and 148*b* are located above seat 104 in the use configuration and the shipping configuration. Pivot points 148*a* and 148*b* are located below bottom 136 of backrest 108 in at least the use configuration. In this way, pivot points 148*a* and 148*b* do not interfere with the material used to cover or upholster furnishing 100 and are ultimately hidden from view and protected from a user with removable seat cushion 102 as illustrated in FIG. 1B.

The triangular structure of backrest 108 provides a fixed edge and at least two free edges. The edge to which front 132 and bottom 136 intersect is the fixed edge 131. Fixed edge 131 is fixed to seat 104 via hinges 142*a* and 142*b* and is the edge to which the rest of backrest 108 rotates about. The edge to which back 134 and bottom 136 intersect is one of the free edges 133. The edge to which front 132 and back 134 intersect is the other of the free edges and is also referred to as the top 135.

In the use configuration and as illustrated in FIG. 4, back 134 is oriented substantially normal to the floor or to bottoms 115 and 117 of first and second frame structures 110 and 112. Still further in the use configuration, at least a portion of backrest 108 protrudes above armrests 116 and 120. More specifically, free edge 133 of backrest 108 (i.e., third frame structure 130) rests on seat 104 while fixed edge 131 of backrest 108 is spaced apart from seat 104 and rotatably coupled to seat 104 by hinges 142*a* and 142*b*. Therefore, in the use configuration, bottom 136 of backrest 108 is oriented at an acute angle 149 relative to seat 104.

In the shipping configuration and as illustrated in FIGS. 9A and 9B, front 132 of backrest 108 (i.e., third frame structure 130) at least partially rests on seat 104 and back 134 no longer is oriented substantially normal to the floor or to bottoms 115 and 117 of first and second frame structures 110 and 112. More specifically, backrest 108 folds down such that the entirety of backrest 108 is located below armrests 116 and 120. In addition, seat cushion 102, which is located on seat surface 124 in the use configuration illustrated in FIG. 1B is positioned within the hollow interior of backrest 108 when in the shipping configuration as illustrated in FIG. 9B. In this way, the dimension for a carton for holding furnishing 100 need only be large enough to contain or accommodate the height dimension of first and second frame structures 110 and 112, the width dimension between the exteriors of first and second frame structures 110 and 112 and the depth dimension between the fronts and backs of first and second frame structures 110 and 112. In this type of packing configuration and carton type, unwanted shifting of the furniture during shipping and uneven weight distributions are eliminated.

A method of assembling furnishing 100 is also provided. Backrest 108 is rotated from a shipping configuration or first position as illustrated in FIGS. 6-10 to a use configuration or second position as illustrated in FIGS. 1-5. In the first position, backrest 108 is entirely positioned below armrests 116 and 120. In the second position, top 135 of backrest 108 is located above armrests 116 and 120. In the first position, front 132 of backrest 108 at least partially rests on seat surface 124 of seat 104. In the second position, back 134 of backrest 108 is oriented substantially normal to a floor or to bottoms 115 and 117 of first and second frame structures 110 and 112.

Backrest 108 is then fastened to seat 104. In particular, bottom 136 of backrest 108 (or third frame structure 130) includes a first fastening body 150 (FIG. 8). First fastening body 150 on furnishing 100 is centrally located along free edge 133 of backrest 108. Seat 104 includes a second fastening body 152. Second fastening body 152 (FIG. 10) is located in proximity to the back of seat 104. A fastener is used to fasten first fastening body 150 to second fastening body 152 and therefore fasten or couple backrest 108 to seat 104. More particularly, a fastener is inserted through first fastening body 150 and second fastening body 152.

In yet another embodiment, to further assemble furnishing 100, cushion 102 is removed from the hollow interior of backrest 108 through the opening in bottom 136 after furnishing 100 is removed from a carton but before backrest 108 is rotated. After backrest 108 is rotated and fastened to seat 104 using fastening bodies 150 and 152 and a fastener, cushion 102 is placed on seat surface 124 of seat 104. Cushion 102 not only acts to provide comfort to a user, but also protects a user from hinges 142*a* and 142*b*.

FIGS. 11-20 illustrate various views of a furnishing 200 according to another embodiment. Furnishing 200 is substantially the same as furnishing 100 including having two hinges 242*a* and 242*b* each having two hinge bodies. One of the differences between furnishing 100 and furnishing 200 is that furnishing 200 is a lounge sofa or loveseat. More specifically, furnishing 200 is longer in width than furnishing 100 so as to accommodate more than a single person or user.

Figure 11A:
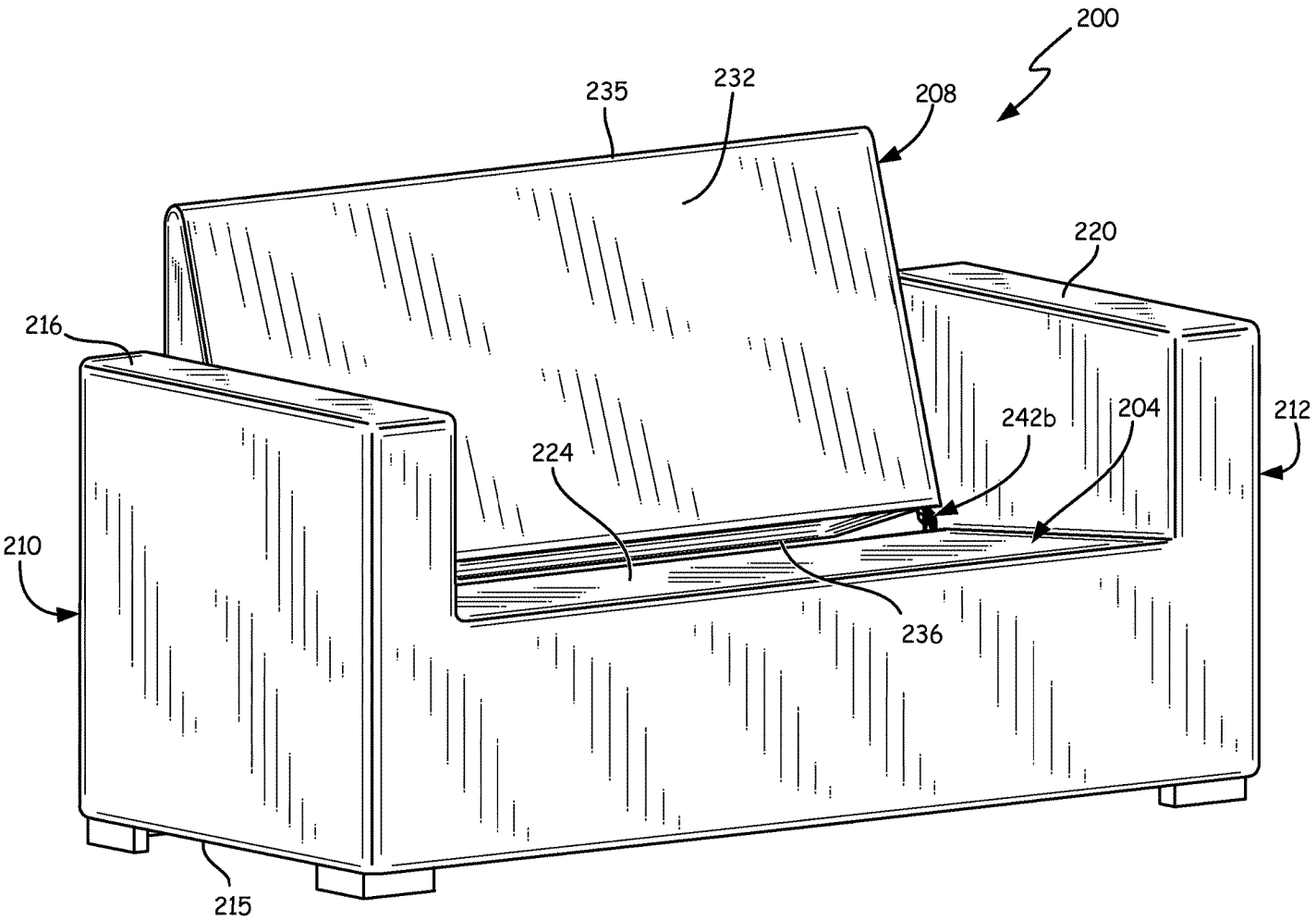
FIG. 11A is a perspective view of a furnishing in a use configuration according to another embodiment.
Figure 11B:
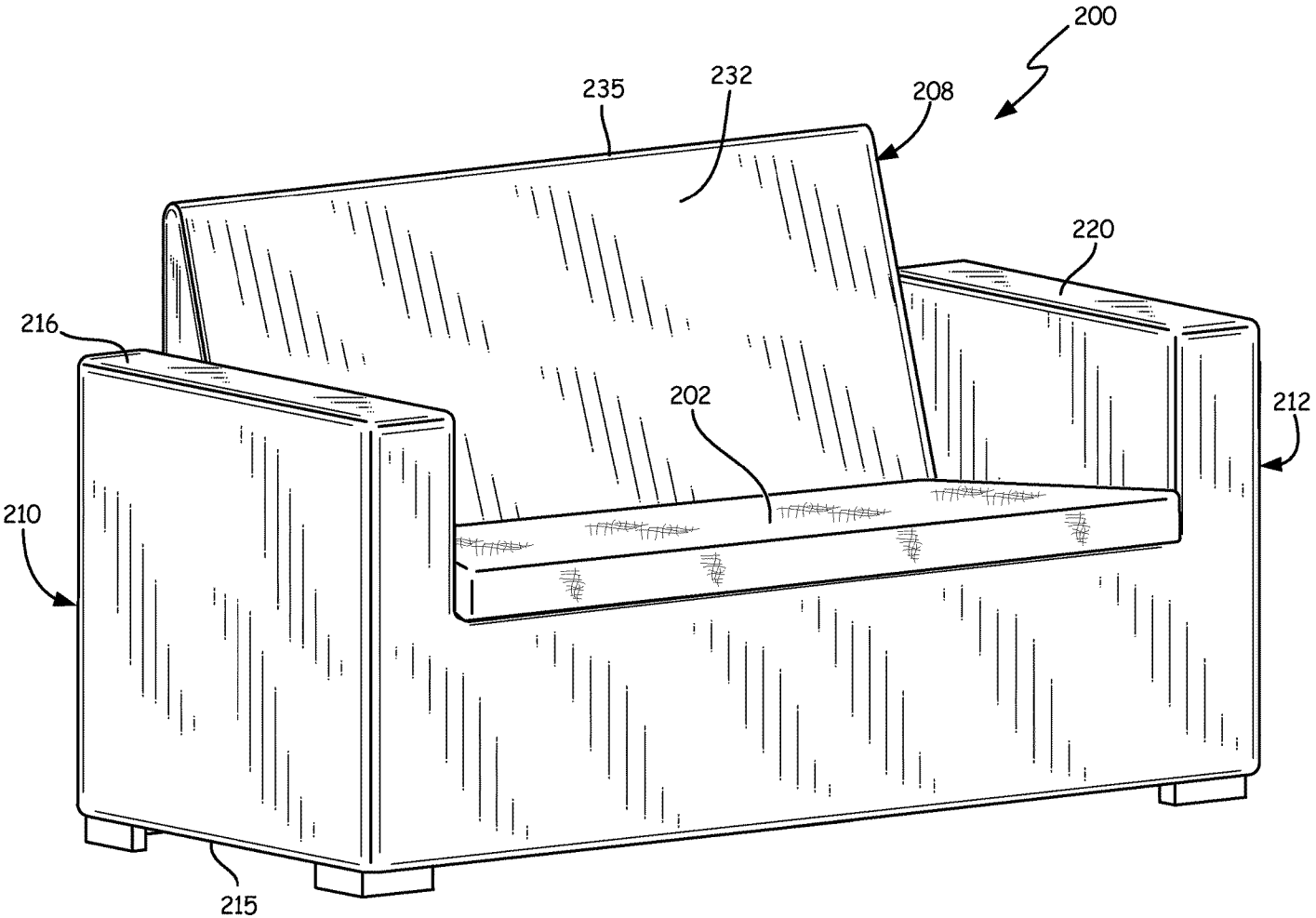
FIG. 11B is a perspective view of FIG. 11A showing a cushion on a seat of the furnishing.
Figure 12:
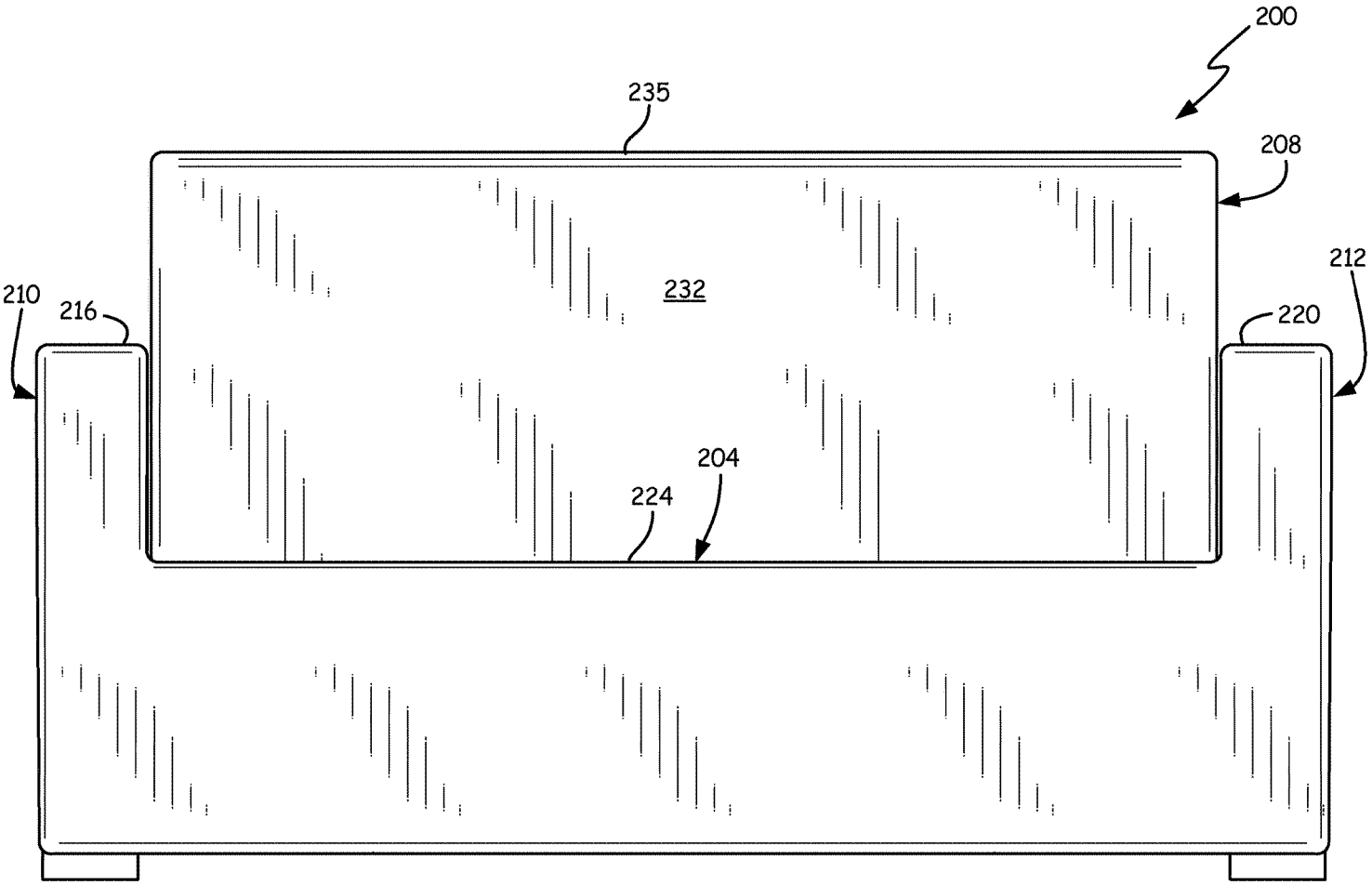
FIG. 12 is a front view of FIG. 11A.
Figure 13:
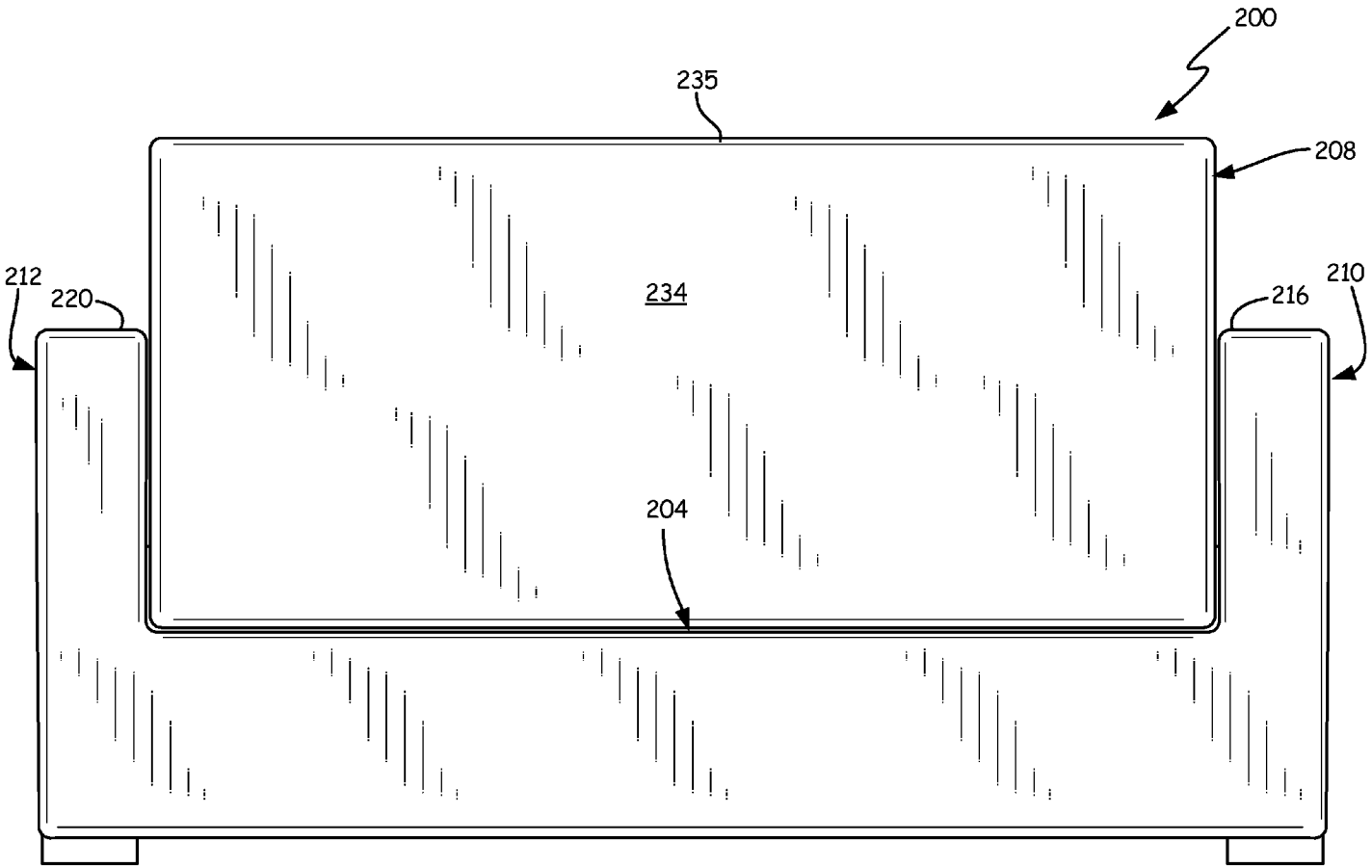
FIG. 13 is a back view of FIG. 11A.
Figure 14:
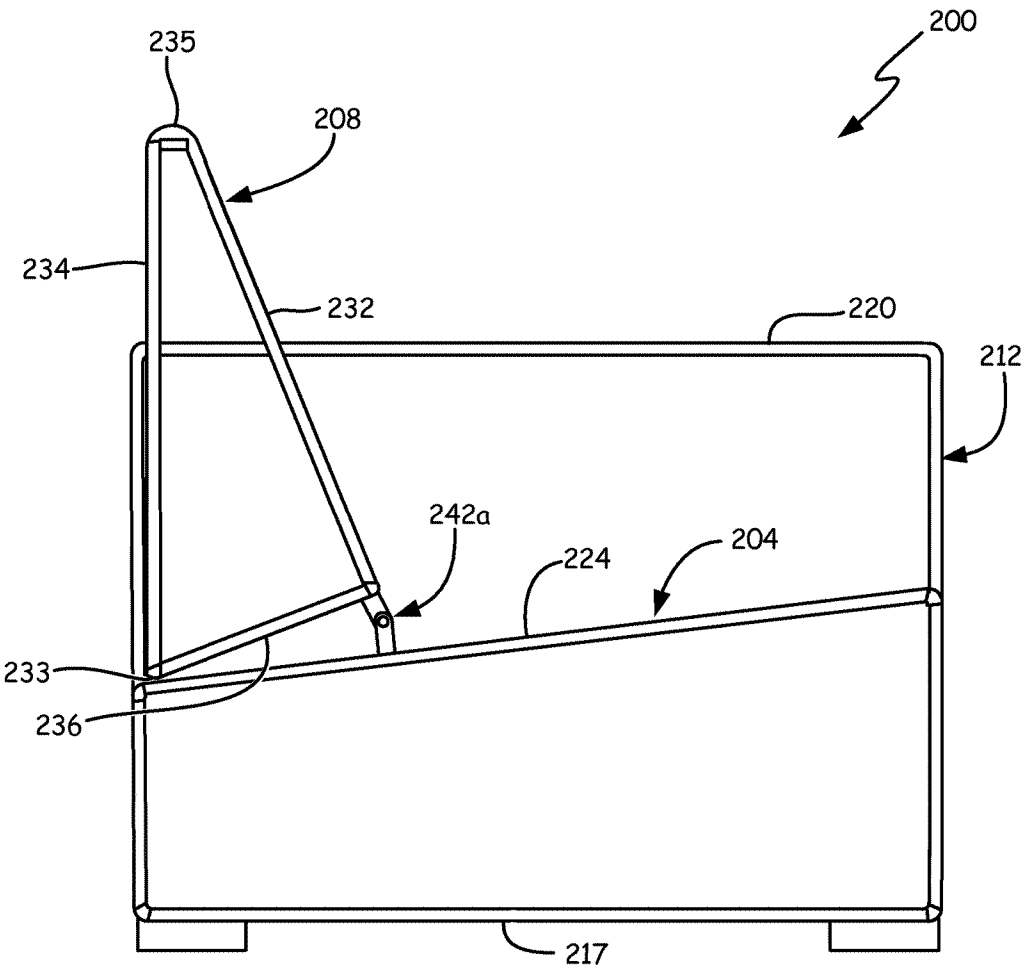
FIG. 14 is a side view of FIG. 11A with a first frame structure and upholstery removed so as to illustrate the structural framework of the furnishing.
Figure 15:
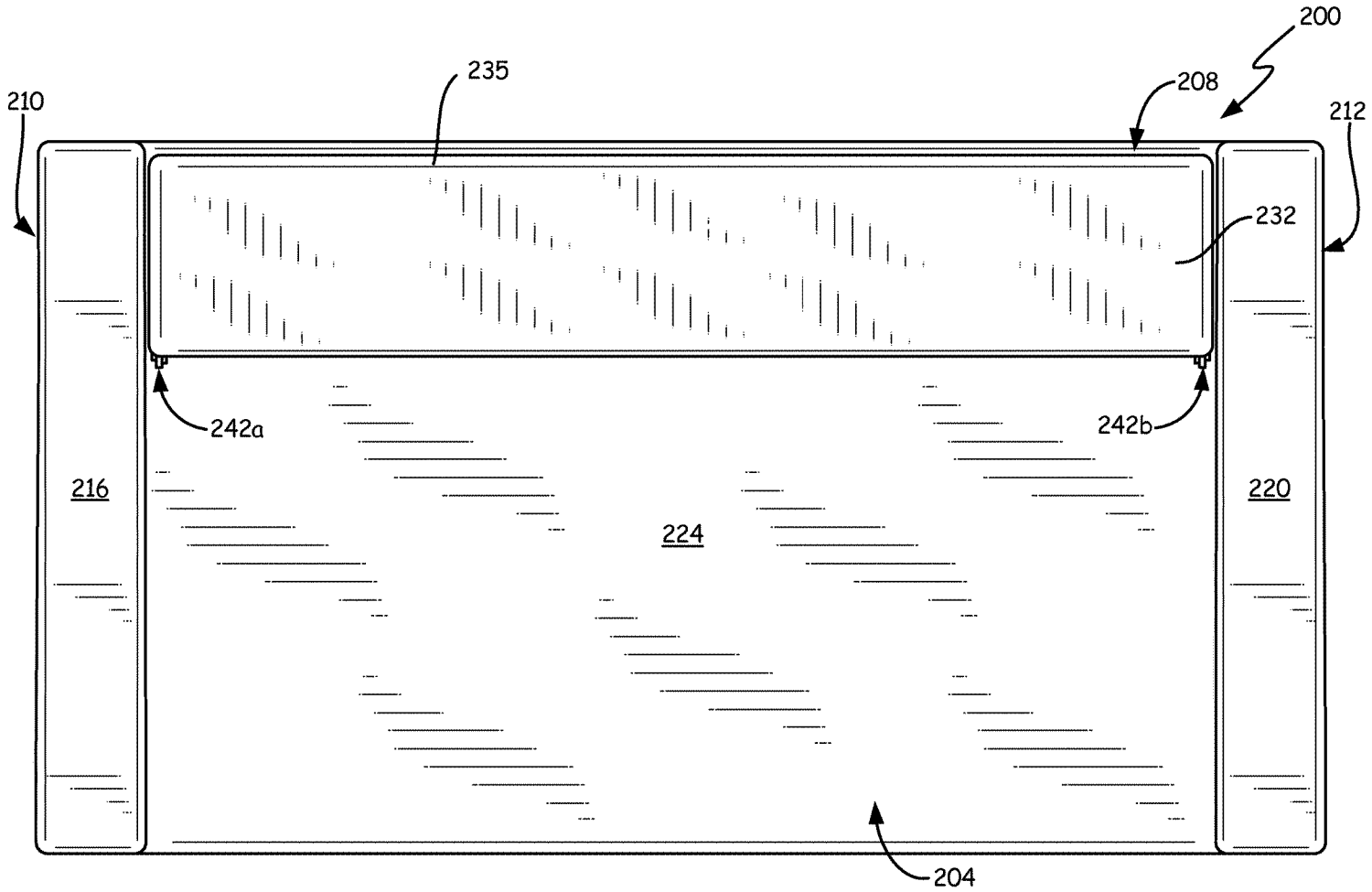
FIG. 15 is a top view of FIG. 11A.

FIG. 11A is a perspective view of a furnishing 200 in a use configuration. FIG. 11B is a perspective view of FIG. 11A showing a cushion 202 on a seat 204 of furnishing 200 in the use configuration. FIG. 12 is a front view of furnishing 200 in the use configuration, FIG. 13 is a back view of furnishing 200 in the use configuration and FIG. 15 is a top view of furnishing 200 in the use configuration. FIG. 14 is a side view with a first frame structure 210 and upholstery, cushioning or other types of material, such as wicker weave, removed so as to illustrate the structural framework of furnishing 200 in the use configuration.

Figure 16:
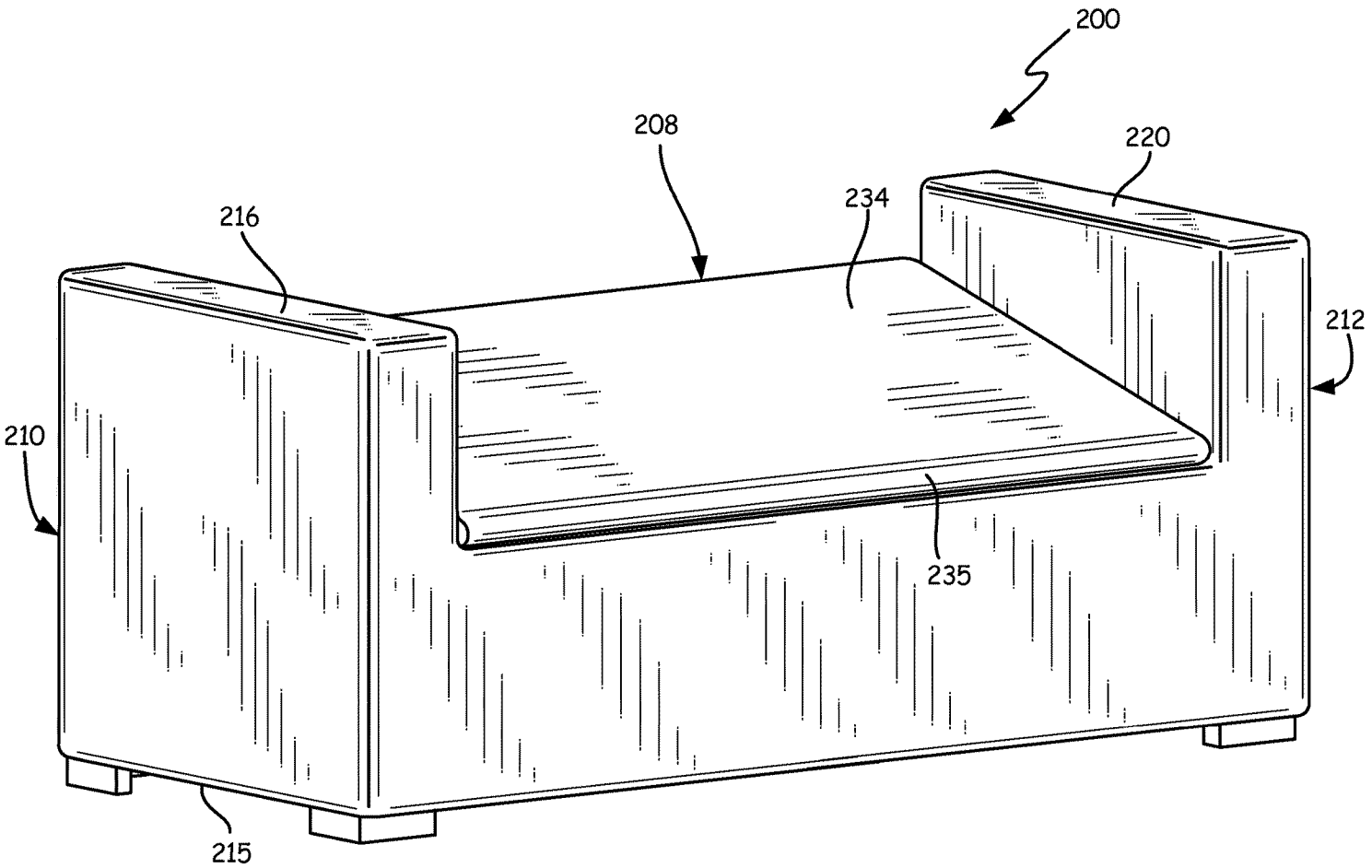
FIG. 16 is a perspective view of the furnishing in FIG. 11A, but in a shipping configuration.
Figure 17:
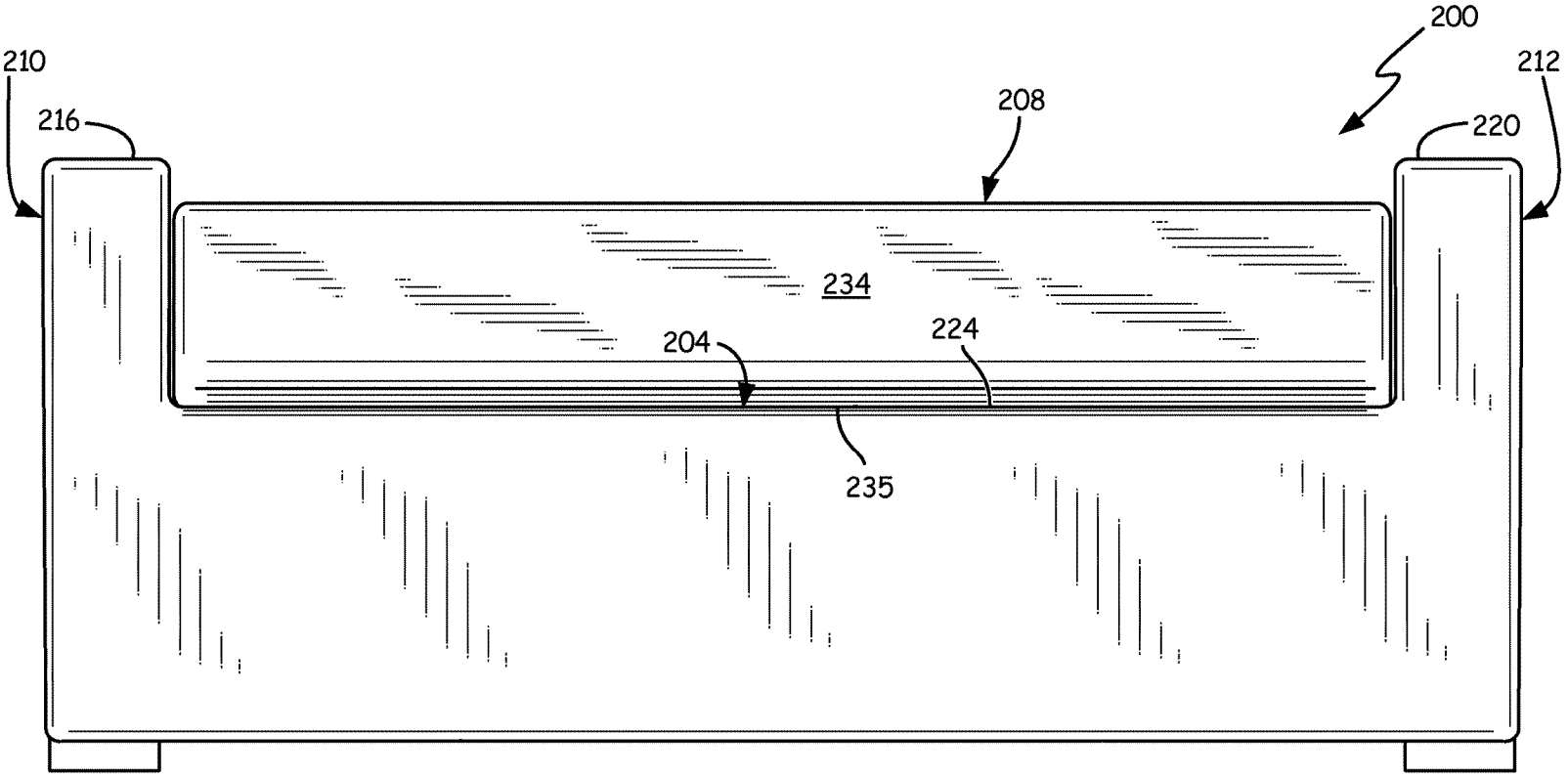
FIG. 17 is a front view of FIG. 16.
Figure 18:
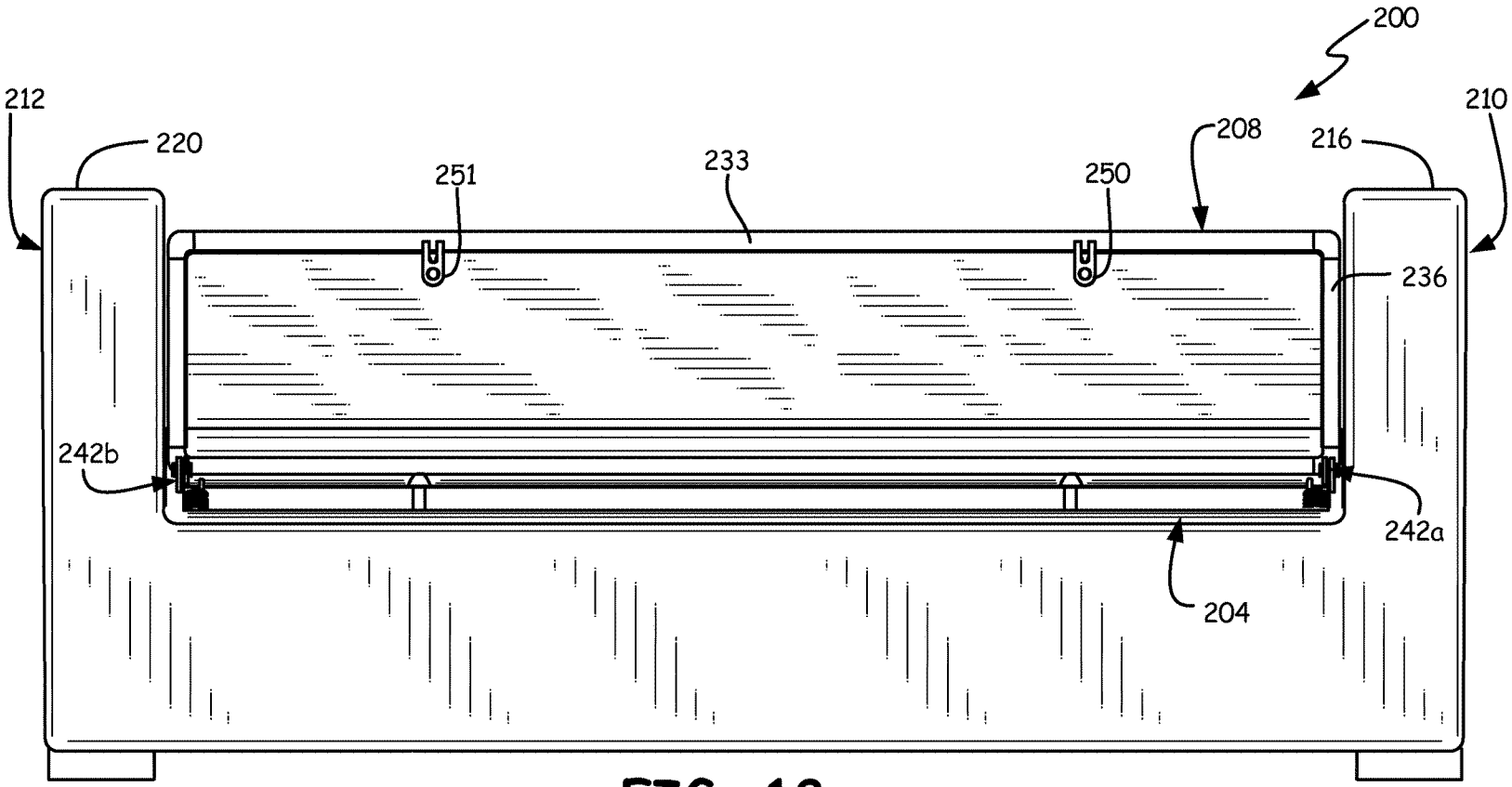
FIG. 18 is a back view of FIG. 16.
Figure 19A:
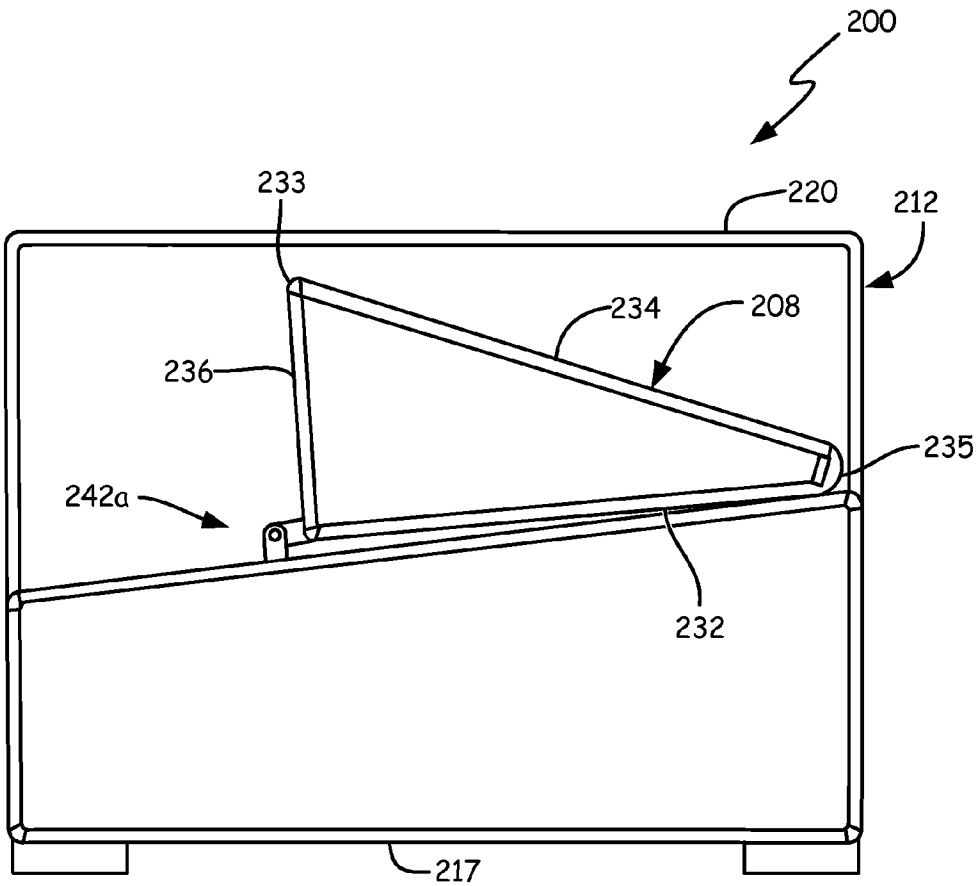
FIG. 19A is a side view of FIG. 16 with a first frame structure and upholstery removed so as to illustrate the structural framework of the furnishing.
Figure 19B:
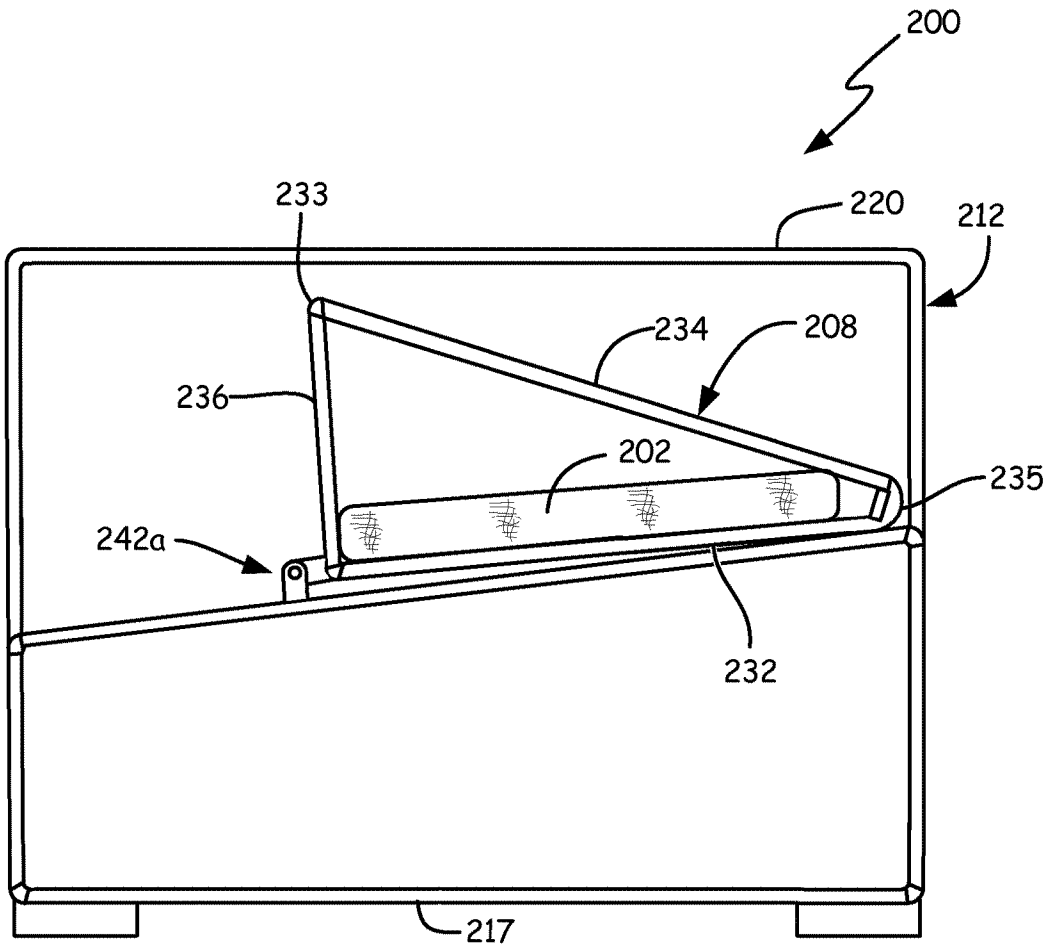
FIG. 19B is the side view of FIG. 19A with a cushion stored inside an interior of the backrest.
Figure 20:
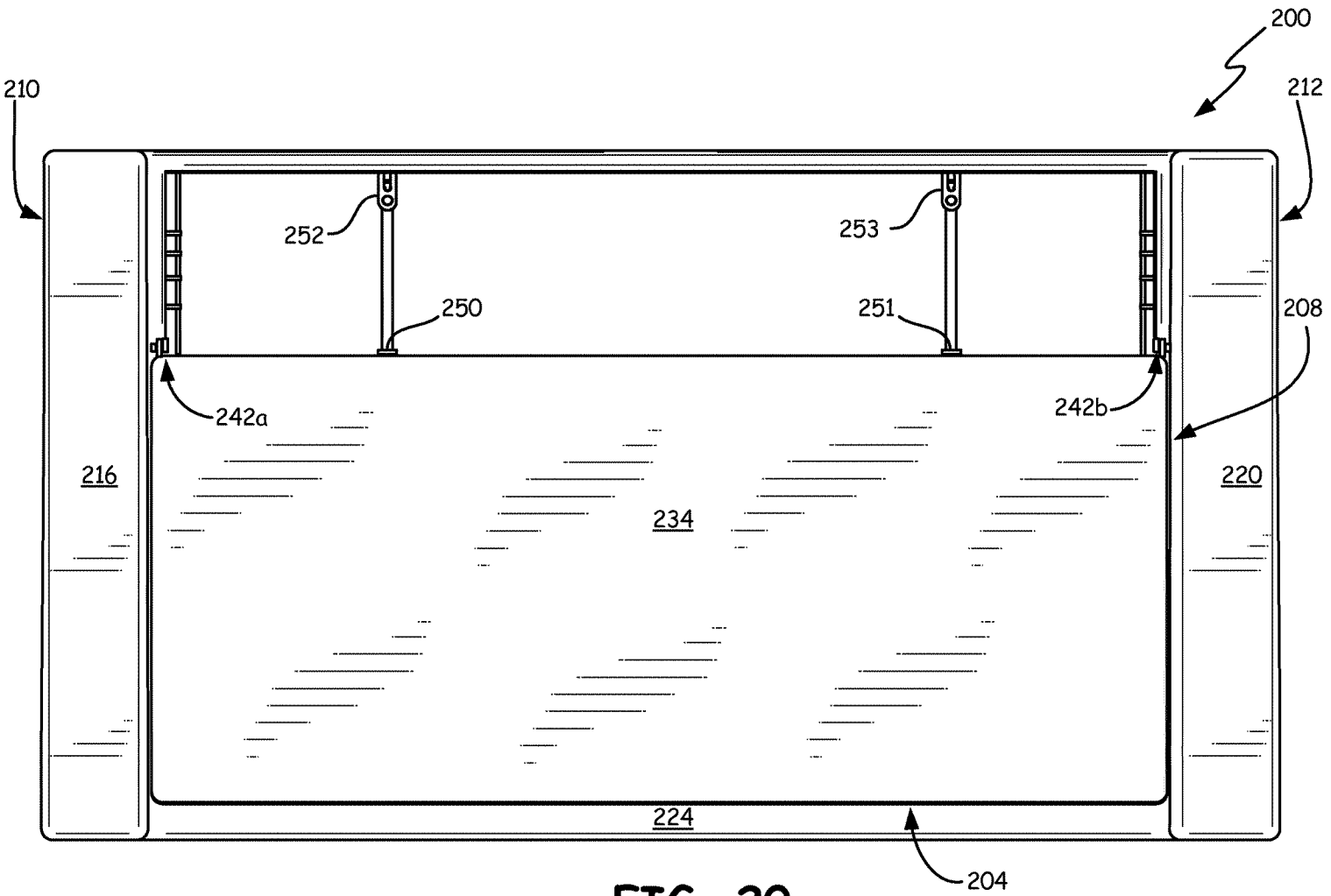
FIG. 20 is a top view of FIG. 16.

FIG. 16 is a perspective view of furnishing 200 in a shipping configuration. FIG. 17 is a front view of furnishing 200 in the shipping configuration, FIG. 18 is a back view of furnishing 200 in the shipping configuration and FIG. 20 is a top view of furnishing 200 in the shipping configuration. FIG. 19A is a side view with a first frame structure 210 and upholstery, cushioning or other types of material, such as wicker weave, removed so as to illustrate the structural framework of furnishing 200 in the use configuration. FIG. 19B is the side view of FIG. 19A, but illustrating cushion 202 being stored inside backrest 208 in the shipping configuration.

To assemble furnishing 200 from the shipping configuration to the use configuration, backrest 208 is rotated from a shipping configuration or first position as illustrated in FIGS. 16-20 to a use configuration or second position as illustrated in FIGS. 11-15 by first and second hinges 242*a* and 242*b*. In the first position, backrest 208 is entirely positioned below armrests 216 and 220. In the second position, a top 235 of backrest 208 is located above armrests 216 and 220. In the first position, front 232 of backrest 208 at least partially rests on seat surface 224 of seat 204. In the second position, back 234 of backrest is oriented substantially normal to a floor or to bottoms 215 and 217 of first and second frame structures 210 and 212.

Backrest 208 is then fastened to seat 204. In particular, bottom 236 of backrest 208 includes a first fastening body 250 (FIGS. 18 and 20) and a second fastening body 251 (FIGS. 18 and 20). First fastening body 250 and second fastening body 251 are spaced apart from each other and located along free edge 233 of backrest 208. Seat 204 includes a third fastening body 252 (FIG. 20) and a fourth fastening body 253 (FIG. 20). Third fastening body 252 (FIG. 10) and fourth fastening body 253 are spaced apart from each other and located in proximity to the back of seat 204. A first fastener is used to fasten first fastening body 250 to third fastening body 252 and a second fastener is used to fasten second fastening body 251 to fourth fastening body 253 and therefore fasten or couple free edge 233 of backrest 208 to seat 204.

In yet another embodiment, to further assemble furnishing 200, cushion 202 is removed from the hollow interior of backrest 208 through the opening in bottom 236 after furnishing 200 is removed from a carton but before backrest 208 is rotated. After backrest 208 is fastened to seat 204 using fastening bodies 250, 251, 252 and 253, cushion 202 is placed on seat surface 224 of seat 204. Cushion 202 not only acts to provide comfort to a user, but also protects a user from hinges 242*a* and 242*b*.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A furnishing comprising:

a seat having an upper seat surface;

a base supporting the seat;

a geometrically shaped backrest that is pivotal relative to the seat and has at least a front, a back, a bottom, a right side and a left side that is substantially parallel with the right side; and at least one hinge that pivots the backrest relative to the seat and comprises:

a first hinge body having a proximal end and a distal end, being attached to the seat at the proximal end and protruding substantially perpendicular from and relative to the upper seat surface; and a second hinge body having a proximal end and a distal end, being attached to the backrest at the proximal end and protruding substantially perpendicular from and relative to the bottom of the backrest;

wherein the first hinge body is coupled to the second hinge body at a pivot point located adjacent to the distal ends of the first hinge body and the second hinge body and wherein the pivot point is spaced apart from the seat by a distance defined between the proximal end and the distal end of the first hinge body and spaced apart from the bottom of the backrest by a distance defined between the proximal end and the distal end of the second hinge body.

2. The furnishing of claim 1, wherein the front of the backrest is substantially normal to the bottom of the backrest.

3. The furnishing of claim 1, wherein the seat is oriented at an acute angle relative to a bottom of the base so that a front of the seat is at a greater height from the bottom of the base than a back of the seat.

4. The furnishing of claim 1, wherein the bottom of the backrest comprises an opening.

5. The furnishing of claim 4, further comprising a seat cushion located on the seat when the backrest is in a use configuration.

6. The furnishing of claim 4, further comprising a seat cushion located in the hollow interior of the backrest when the backrest is in a shipping configuration.

7. The furnishing of claim 1, wherein the back of the backrest is oriented substantially normal to a bottom of the base when the backrest is in a use configuration.

8. The furnishing of claim 1, wherein the back of the backrest intersects the bottom of the backrest at a free edge and the front of the backrest intersects the bottom of the backrest at a fixed edge, the fixed edge being rotatably attached to the seat by the at least one hinge and the free edge contacting the seat when the backrest is in a use configuration.

9. The furnishing of claim 1, wherein the bottom of the backrest is oriented at an acute angle relative to the seat when the backrest is in a use configuration.

10. The furnishing of claim 1, wherein the front of the backrest at least partially rests on the seat when the backrest is in a shipping configuration.

11. A furnishing comprising:

a first frame structure forming a first leg support and having a bottom and a first armrest;

a second frame structure spaced apart from the first frame structure and forming a second leg support having a bottom and a second armrest;

a seat located between the first frame structure and the second frame structure and being positioned above the bottoms of the first and second frame structures, being positioned below the first and second armrests of the first and second frame structures and forming a seat surface;

a third frame structure located between the first frame structure and the second frame structure, the third frame structure being rotatably coupled to the seat and forming a backrest;

at least one hinge that rotates the third frame structure relative to the seat and comprises:

a first hinge body having a proximal end and a distal end, being attached to the seat at the proximal end and protruding substantially perpendicular from and relative to the seat surface;

a second hinge body having a proximal end and a distal end, being attached to the third frame structure at the proximal end and protruding from a bottom of the third frame structure, wherein the first hinge body is coupled to the second hinge body at a pivot point and wherein the pivot point is spaced apart from the seat surface by a distance defined between the proximal end and the distal end of the first hinge body and is spaced apart from the bottom of the third frame structure by a distance defined between the proximal end and the distal end of the second hinge body;

wherein the third frame structure is located entirely below the first armrest and the second armrest when the third frame structure is in a shipping configuration; and wherein the third frame structure protrudes above the first armrest and the second armrest when the third frame structure is in a use configuration.

12. The furnishing of claim 11, wherein the third frame structure comprises a hollow interior defined by a front, the back, a bottom having an opening, a right side and a left side that is substantially parallel with the right side.

13. The furnishing of claim 12, wherein the back of the third frame structure is oriented substantially normal to the bottoms of the first and second frame structures when the third frame structure is in a use configuration.

14. The furnishing of claim 12, wherein the front of the third frame structure at least partially rests on the surface that forms the seat when the third frame structure is in a shipping configuration.

15. The furnishing of claim 12, wherein the bottom of the third frame structure comprises a first fastening body and the seat comprises a second fastening body, the first fastening body being fastened to the second fastening body with a fastener when the third frame structure is in a use configuration.

16. A furnishing comprising:

a seat having a seat surface; and a backrest pivotally coupled to the seat by at least one hinge and being rotatable from a first position where the backrest is entirely positioned below a pair of armrests that protrude upwardly from the seat to a second position where a top of the backrest is located above the pair of armrests; and wherein the at least one hinge comprises:

a first hinge body having a proximal end and a distal end, being attached to the seat at the proximal end and protruding substantially perpendicular and relative to the seat surface; and a second hinge body having a proximal end and a distal end, being attached to the backrest at a proximal end and protruding substantially perpendicular from and relative to a bottom of the backrest, wherein the first hinge body and the second hinge body are coupled together at a pivot point that is spaced apart from the seat surface by a distance defined between the proximal end and the distal end of the first hinge body and is spaced apart from the bottom of the backrest by a distance defined between the proximal end and the distal end of the second hinge body.

17. The furnishing of claim 16, wherein the backrest being rotatable from the first position to the second position comprises the backrest being rotatable from a location where a front of the backrest at least partially rests on a surface of the seat to a location where a back of the backrest is oriented substantially normal to a bottom of a base of the furnishing.

18. The furnishing of claim 16, further comprising a first fastener body located on a bottom of the backrest and a second fastener body located on the seat, wherein a fastener is inserted through the first fastener body and through the second fastener body located on the seat to fasten the backrest to the seat after being rotated to the second position.

19. The furnishing of claim 16, further comprising a cushion located within a hollow interior of the backrest that is removed before rotating the backrest from the first position to the second position, wherein the hollow interior is defined by a front, a back, a right side, a left side, a top and the bottom having an opening and wherein the cushion is placed on the seat after the backrest is rotated from the first position to the second position.

* * * * *